US008827440B2

(12) United States Patent
Inokuchi et al.

(10) Patent No.: US 8,827,440 B2
(45) Date of Patent: Sep. 9, 2014

(54) PRINTER

(71) Applicants: Citizen Holdings Co., Ltd., Tokyo (JP); Citizen Systems Japan Co., Ltd., Tokyo (JP)

(72) Inventors: Yutaka Inokuchi, Iida (JP); Yuichi Taguchi, Iida (JP); Akira Takahashi, Iida (JP); Takeshi Yamazaki, Iida (JP); Shinya Hosoda, Shimoina-gun (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 0 days.

(21) Appl. No.: 13/931,786

(22) Filed: Jun. 28, 2013

(65) Prior Publication Data

US 2014/0071194 A1 Mar. 13, 2014

(30) Foreign Application Priority Data

Sep. 11, 2012 (JP) ..... 2012-200005

(51) Int. Cl.

| | |
|---|---|
| ***B41J 2/01*** | (2006.01) |
| ***B41J 11/70*** | (2006.01) |
| ***B41J 3/60*** | (2006.01) |
| ***B41J 15/00*** | (2006.01) |
| *B41J 13/00* | (2006.01) |

(52) U.S. Cl.

CPC .. *B41J 3/60* (2013.01); *B41J 11/70* (2013.01); *B41J 13/0045* (2013.01); *B41J 15/00* (2013.01); *B41J 13/0009* (2013.01); *B41J 13/00* (2013.01)

USPC ..... 347/104; 347/101; 347/16

(58) Field of Classification Search

CPC ..... B41J 3/60

See application file for complete search history.

(56) References Cited

U.S. PATENT DOCUMENTS

2010/0245514 A1* 9/2010 Kaimoto et al. ..... 347/104

FOREIGN PATENT DOCUMENTS

JP 2011093256 5/2011

* cited by examiner

*Primary Examiner* — Julian Huffman

(74) *Attorney, Agent, or Firm* — Myers Wolin, LLC

(57) ABSTRACT

A printer includes a printer unit that performs a recording operation on a recording medium pulled out from a first recording medium holding unit and on a recording medium held by a second recording medium holding unit included in a paper-feeding/paper-reversing unit. The paper-feeding/paper-reversing unit has a third recording medium transportation path in which the side of the recording medium to be subject to simplex recording is switched and through which the recording medium is fed back to a recording unit of the printer unit. The third recording medium transportation path partially overlaps a second recording medium transportation path through which the recording medium is fed to the printer unit.

7 Claims, 22 Drawing Sheets

PRINTER

CROSS-REFERENCE TO RELATED APPLICATIONS

The present application claims priority to Japanese Application No. 2012-200005 filed on Sep. 11, 2012, the contents of which are incorporated by reference herein.

FIELD OF THE INVENTION

The present invention relates to a printer that can record on both sides of a recording medium.

DESCRIPTION OF THE RELATED ART

Conventional printers are known that based, on received, command information from an external device; perform a recording operation with respect to a recording medium, serving as an imprinting subject. Such printers include a printer that performs a recording operation with respect to a single side as well as both sides of the recording medium. Such a printer cuts a rolled recording medium into a given, length and uses the resulting segment or uses a pre-cut recording medium of a given length.

For example, according to a conventional technique, a printer unreels a rolled recording medium while performing a recording operation with respect to the recording medium using a thermal head, and rotates the rolled recording medium as a whole to switch the side of the recording medium exposed to the thermal head to thereby perform recording operations on both sides of the recording medium (see, e.g., Japanese Patent Application Laid-Open Publication No. 2011-93256).

The conventional technique described in the patent document indicated above poses a problem in that providing the printer with a mechanism that rotates the rolled recording medium as a whole to switch the side of the recording medium exposed to the thermal head increases the size of the printer.

According to the conventional technique described in the patent document, the rolled, recording medium is used for a recording operation with respect to a single side of the recording medium (hereinafter, referred to as "simplex recording" as appropriate) as well as for a recording operation with respect to both sides of the recording medium (hereinafter, referred to as "duplex recording" as appropriate).

The demanded properties of the recording medium for simplex recording differ from those for duplex recording. It is preferable that a recording medium suitable for simplex recording be used when simplex recording is performed and that a recording medium suitable for duplex recording be used when duplex recording is performed. According to the conventional technique described in Patent Document 1, the same type of recording medium is used regardless of whether simplex recording or duplex recording is performed. Consequently, a problem arises in that use of the same type of recording medium results recording quality that is inferior compared to that in a case where recording media respectively suitable for each recording operation are used.

To solve the problems of the conventional technique an object is to provide a printer that ensures a high recording quality by using a recording medium according to use and that suppresses an increase in the size of the printer resulting from storage of the recording media for each use.

SUMMARY OF THE INVENTION

It is an object of the present invention to at least solve the above problems in the conventional technologies.

A printer according to one aspect of the present invention includes a recording unit and a reversing unit. The recording unit includes a first recording medium holding unit that holds a rolled recording medium such that the recording medium can be pulled out from an outer peripheral aspect; a recording unit that pulls out the recording medium held by the first recording medium holding unit, transports the pulled out recording medium through a first recording medium transportation path extending from the first recording medium, holding unit to a first recording medium ejection position, and performs a recording operation on the recording medium on transportation; and a first recording medium, cutting unit that cuts the recording medium transported through the first recording medium transportation path by the recording unit, at a given position before the recording medium reaches the first recording medium ejection position. The reversing unit includes a second recording medium holding unit that holds a sheet-like recording medium; a sheet feeding unit that pulls out the sheet-like recording medium held by the second recording medium holding unit to a second recording medium transportation path extending from, the second recording medium holding unit, to the first recording medium transportation path, the sheet feeding unit feeding the pulled out sheet-like recording medium to the first recording medium transportation path; and a recording medium reversing unit that with respect to the sheet-like recording medium ejected from the recording unit to a third recording medium transportation path of which both ends are continuous with the first recording medium transportation path, switches relative to a recording position of the recording unit, the side of the sheet-like recording medium to be subject to recording, and feeds the sheet-like recording medium to the first recording medium transportation path. The recording unit performs a recording operation on the sheet-like recording medium that has been fed to the first recording medium transportation path by the sheet feeding unit and on the sheet-like recording medium that has been subject to switching by the recording medium reversing unit and fed to the first recording medium transportation path.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Embodiments of a printer will be described in detail with reference to the accompanying drawings.

Figure 1:
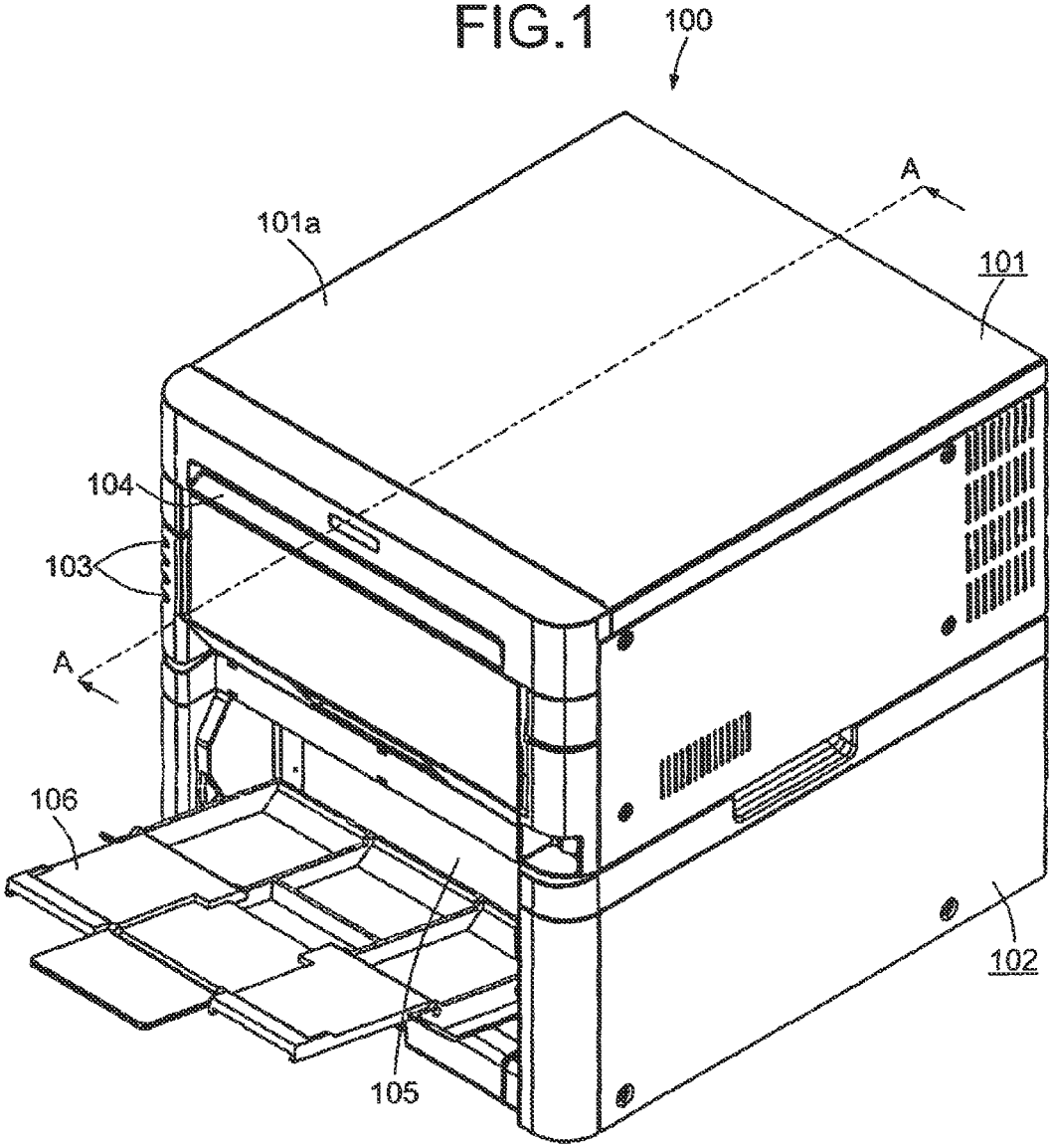
FIG. 1 is an explanatory diagram of the exterior of a printer according to embodiments.

The exterior of a printer according to the embodiments will be described. FIG. 1 is an explanatory diagram of the exterior of the printer according to the embodiments. In FIG. 1, a printer 100 according to the embodiments has a substantially boxlike exterior. The printer 100 includes a printer unit (recording unit) 101 and a paper-feeding/paper-reversing unit (reversing unit) 102.

The printer 100 is used placed on, for example, an upper surface of a stand. When the printer 100 is in an installed state, the printer unit 101 is disposed above the paper-feeding/paper-reversing unit 102, so that the paper-feeding/paper-reversing unit 102 is disposed beneath the printer unit 101. The printer unit 101 and the paper-feeding/paper-reversing unit 102 can be separated from each other.

A connecting part between the printer unit 101 and the paper-feeding/paper-reversing unit 102 has a shape (not depicted) for positioning the printer unit 101 and the paper-feeding/paper-reversing unit 102. As a result, when the printer unit 101 and the paper-feeding/paper-reversing unit 102 are configured to be separable from each other, the positional relation between the printer unit 101 and the paper-feeding/paper-reversing unit 102 can be established accurately and easily. An enclosure 101*a* for the printer 100 (printer unit 101) has various status reporting lamps 103 that report the status of the printer 100.

The printer 101 performs a recording operation on a recording medium (photographic paper) serving as an imprinting subject. Relative to a recording position of the printer unit 101, the paper-feeding/paper-reversing unit 102 switches the side of the recording medium to be exposed for recording and subsequently feeds the recording medium to the printer unit 101. The printer unit 101 performs a recording operation on the recording medium subjected to the switching and thereby, performs duplex recording on the recording medium.

The printer 100 according to the embodiments performs a recording operation by a so-called sublimation/transfer method, by which thermally diffusive pigments (sublimable pigments) in an ink layer of an ink ribbon is transferred to a recording layer of the recording medium serving as the imprinting subject. Such a printer performing the recording operation by the sublimation/transfer method is referred to as, for example, dye-sublimation printer.

The printer 100 is a dye-sublimation printer and the recording medium having the recording layer is the imprinting subject of the printer 100. The recording layer of the recording medium is formed on the surface of a substrate made of paper, etc. The recording layer is composed of a heat-insulating layer applied to or adhered to the substrate and a receiving layer overlaid on the heat-insulating layer. The thermally diffusive pigments (sublimable pigments) in the ink layer of the ink ribbon are transferred to the receiving layer.

The printer 100 according to the embodiments uses a recording medium suitable for single-sided recording when performing a recording operation on a single side of the recording medium (simplex recording) and uses a recording medium suitable for double-sided recording when performing a recording operation on both sides of the recording medium (duplex recording). For example, the recording medium suitable for simplex recording has a recording layer formed on a single side of the substrate of the recording medium alone. For example, the recording medium suitable for duplex recording has recording layers formed on both sides of the substrate of the recording medium.

The dye-sublimation printer can adjust the density of ink transferred to the recording medium for each dot. The dye-sublimation printer is, therefore, excellent in expressing gradation. Being capable of superior gradation expression, the dye-sublimation printer offers image quality that is applicable to photographic printing. For this reason, the dye-sublimation printer is used for DTP applications in recent years.

The ink ribbon used for the recording operation by the sublimation/transfer method has an elongated substrate and ink layers formed on a single side of the substrate. The ink ribbon has ink layers of multiple colors. For example, the ink ribbon used, by the printer 100 of the embodiments has ink layers colors including yellow (Y), magenta (M), and cyan (C). Each ink layer is made of ink composed of sublimable dye ink (a sublimable dye ink (sublimable pigment), e.g., sublimable ink).

In the ink ribbon, the colored ink layers are arranged along the length of the substrate in repeating cycles according to color. For example, the ink layers of yellow (Y), magenta (M), and cyan (C) are arranged along the length of the substrate in the order of "ink layer of yellow (Y)→ink layer of magenta (M)→ink layer of cyan (C)→ . . . ".

The ink ribbon used for the recording operation by the sublimation/transfer method has overcoat layers. The overcoat layers are arranged along the length of the substrate in cycles together with the ink layers. For example, the ink ribbon used by the printer 100 of the embodiments has overcoat layers arranged along the length of the substrate in the order: "ink layer of yellow (Y)→ink layer of magenta (M)→ink layer of cyan (C)→overcoat layer→ink layer of yellow (Y)→ . . . ".

In the recording operation, the printer 100 forms an overcoat layer on a surface of the recording medium subjected to the recording operation (hereinafter, referred to as "recording surface") so that the overcoat layer covers the recording surface. As a result, the deterioration of the water resistance and weather resistance of the sublimable aye ink in a recorded object is suppressed, improving the water resistance and weather resistance of the recorded object.

The printer 100 includes a simplex print ejection outlet 104 disposed in the printer unit 101 and a duplex print ejection outlet 105 disposed in the paper-feeding/paper-reversing unit 102. The printer 100 ejects a recorded object subjected to the recording operation by the printer unit 101, out of the enclosure 101*a* through the simplex print ejection outlet 104 and the duplex print ejection outlet 105.

In this embodiment, a first recording medium ejection position is realized as a position at which a recorded object is ejected through the simplex print ejection outlet 104. Further, a second recording medium ejection position is realized as a position at which a recorded object is ejected through the duplex print ejection outlet 105. A recorded object subjected to simplex recording is ejected out of the enclosure 101*a* through the simplex print ejection outlet 104, and is placed (stacked) on an ejected-paper tray (not depicted) set near the simplex print ejection outlet 104. A recorded object subjected to duplex recording is ejected out of the enclosure 101*a* through the duplex print ejection outlet 105, and is placed (stacked) on an ejected-paper tray 106.

(Internal Configuration of Printer 100)

An internal configuration of the printer 100 of the embodiments will be described. FIGS. 2, 3, 4, and 5 are sectional views, along line A-A in FIG. 1, of the printer depicted in FIG. 1. In FIGS. 2, 3, 4, and 5, the printer unit 101 includes a control board, which is not depicted. The control board, has a microcomputer that drives and controls each of the units of the printer 100 (see FIG. 6).

The printer unit 101 also includes a first recording medium holding unit 201. The first recording medium holding unit 201 holds a recording medium P which has a recording layer formed on a single side of the substrate and is suitable for simplex recording. The recording medium P held by the first recording medium holding unit 201 is of an elongated shape and is rolled about an axis parallel to the short edge of the first recording medium. The first recording medium holding unit 201 holds the rolled recording medium P such that the recording medium P can be unreeled from an outer peripheral aspect. The recording medium P held by the first, recording medium holding unit 201 will hereinafter be referred to as "rolled paper" as appropriate and denoted by P1 for explanation.

For example, the first recording medium holding unit 201 holds a core, around which the rolled paper P1 is wound. The core is held in a state that enables the core to rotate. Thus, the first recording medium holding unit 201 holds the rolled paper P1 in a state in which the outer peripheral end of the rolled paper P1 can be pulled out from the first recording medium holding unit 201.

The printer unit 101 includes a first recording medium transportation path 202. The first recording medium transportation path 202 is formed, between the simplex print ejection outlet 104, which leads to the first recording medium ejection position, and the first recording medium holding unit 201; and extends from the first recording medium holding unit 201 to the simplex print ejection outlet 104.

A first paper sensor 203 is disposed near the boundary position between the first recording medium holding unit 201 and the first recording medium transportation path 202. An output value from, the first paper sensor 203 changes depending on the presence or absence of the recording medium P (rolled paper P1), which is pulled out from the first recording medium, holding unit 201 into the first recording medium transportation path 202. For example, the first paper sensor 203 can be realized in the form of, for example, a microswitch or photosensor.

The printer unit 101 includes a recording unit 204. The recording unit 204 has a thermal head 205 and a platen 206. The thermal head 205 and the platen 206 are arranged to oppose one another across the first recording medium transportation path 202. The thermal head 205 is disposed enabling movement to a position at which the thermal head 205 is in contact with the platen 206 and to a position at which the thermal head 205 is away from the platen 206.

Figure 2:
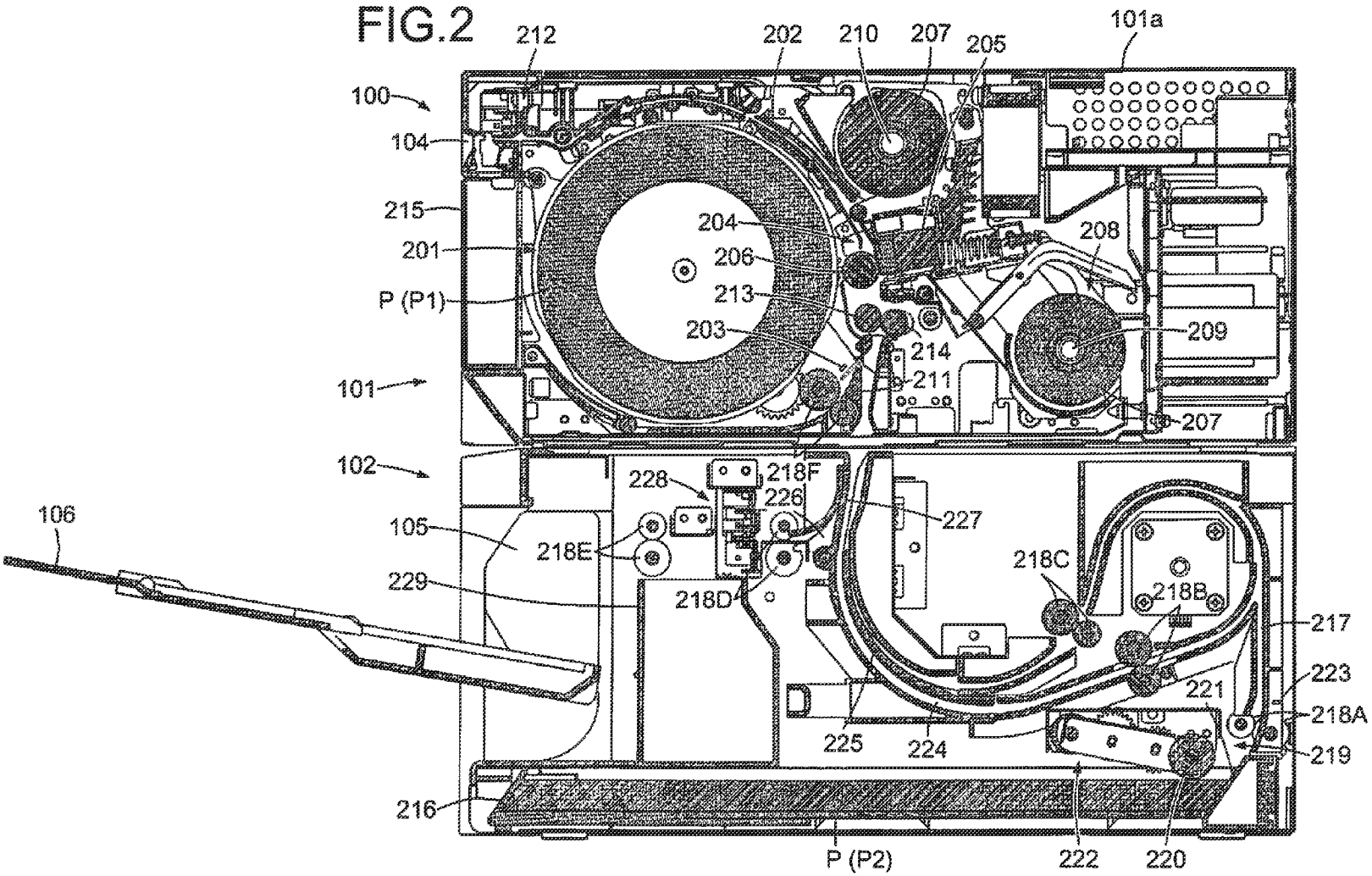
FIGS. 2, 3, 4, and 5 are sectional views, along line A-A in FIG. 1, of the printer depicted in FIG. 1.
Figure 3:
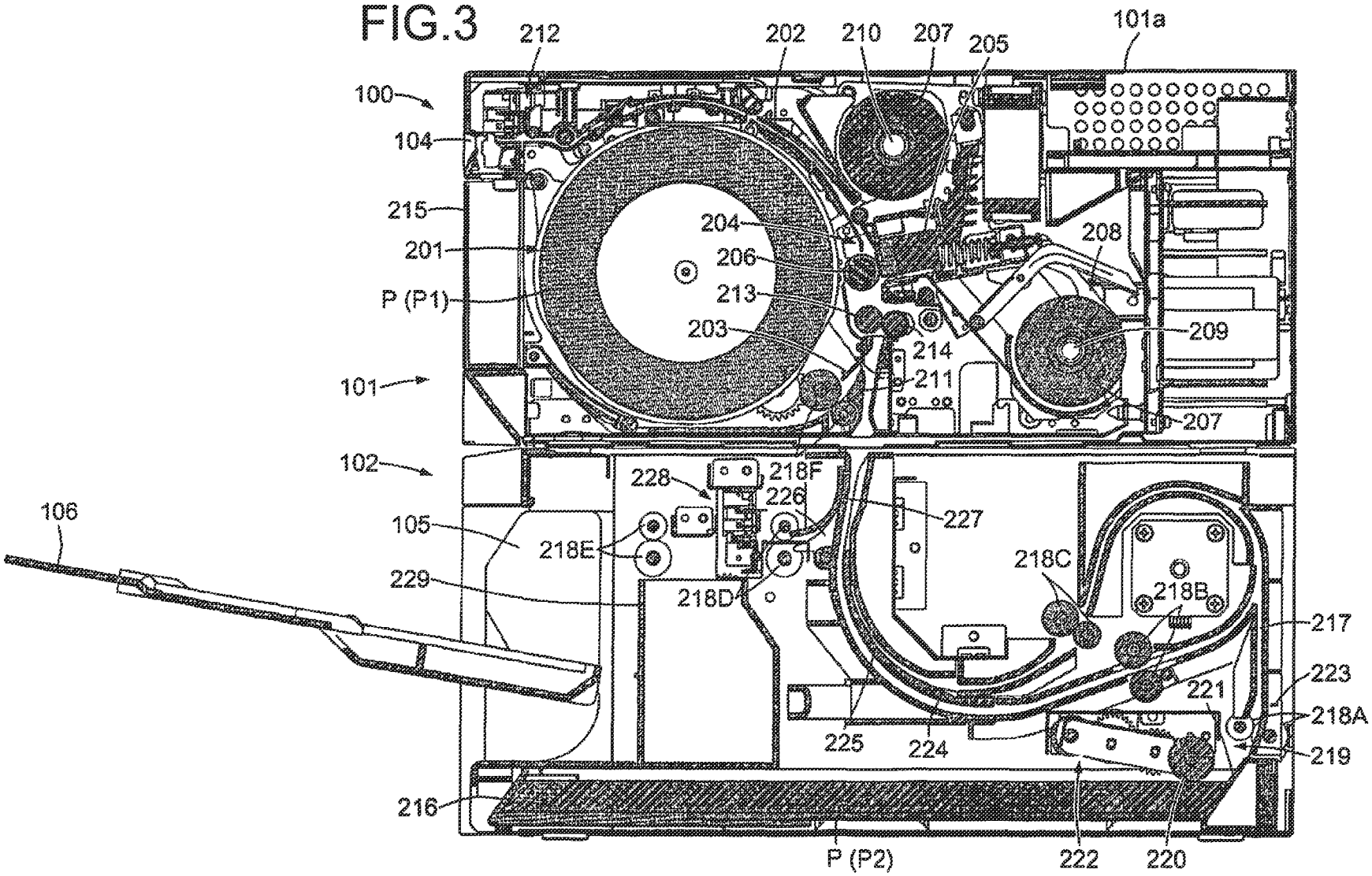
Figure 4:
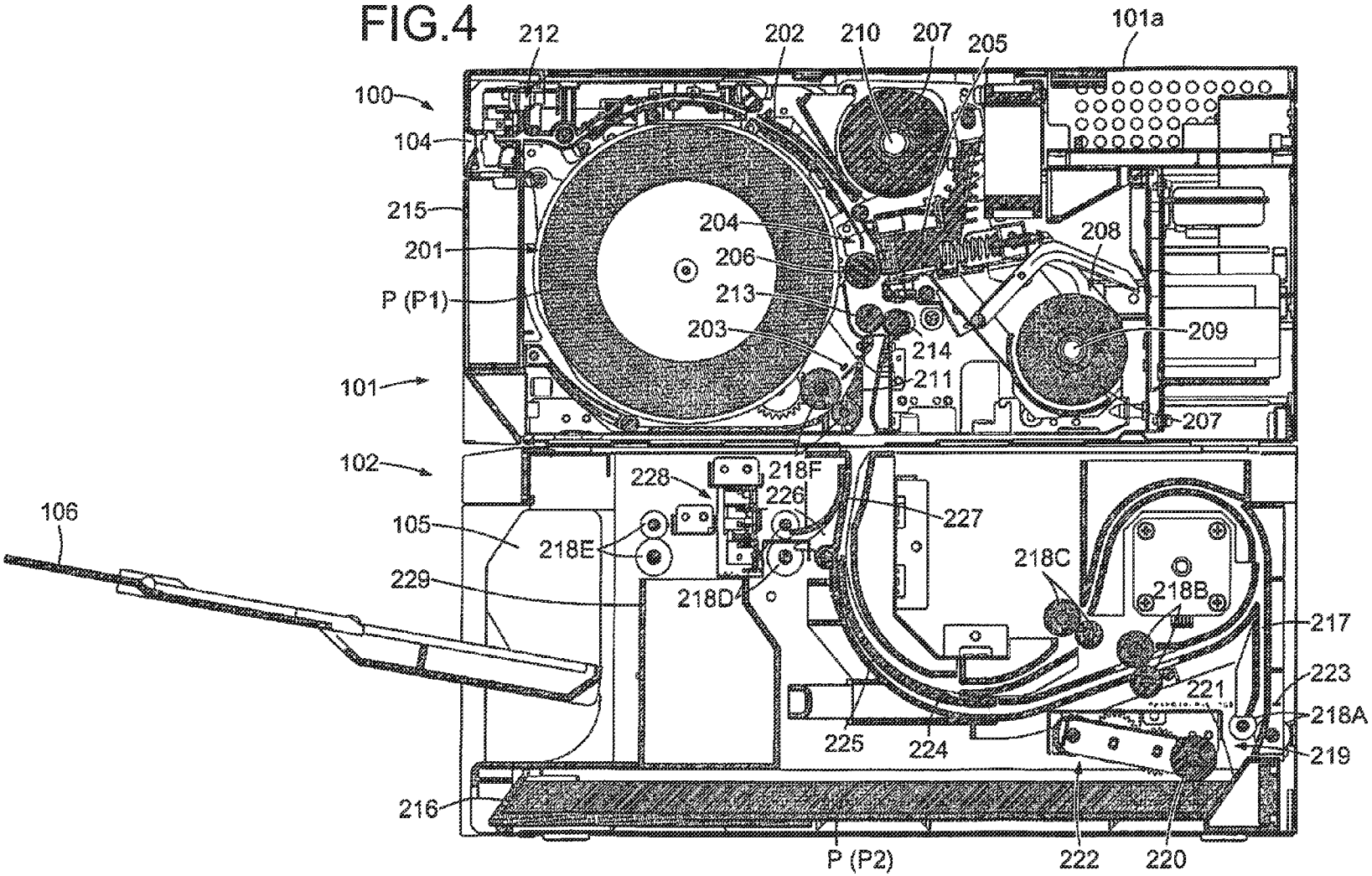
Figure 5:
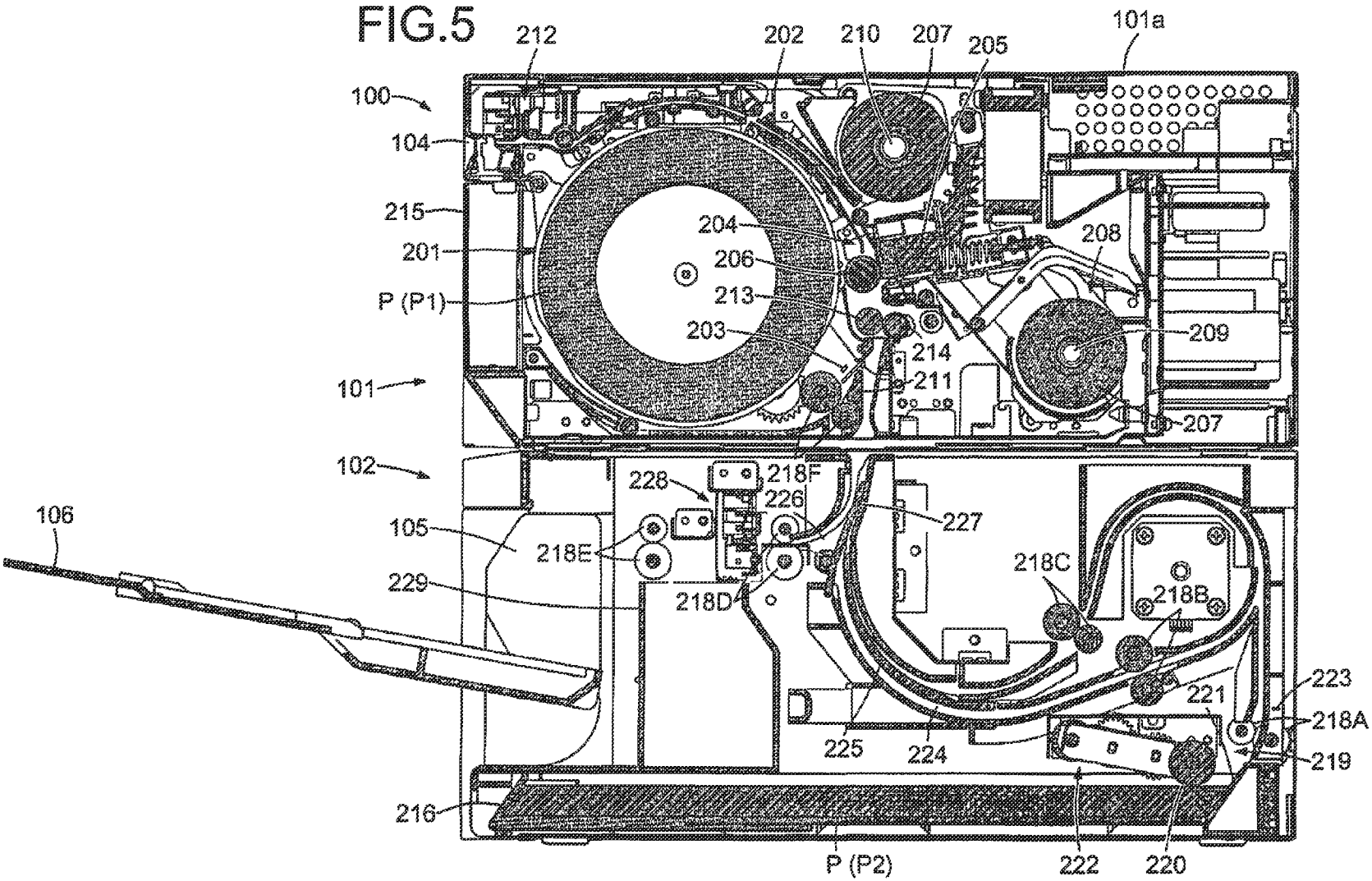

The thermal head 205 has multiple heat-generating elements (heat-generating resistors) arranged, along a line parallel to the short edge of the recording medium P (with respect to Fig., the line being perpendicular to the surface of the page on which FIG. 2 is printed), a driver IC that drives the heat-generating elements (see FIG. 6), etc. The driver IC uses a power supply (not depicted) to selectively energizes electrode wires respectively connected to the heat-generating elements and thereby, causes the heat-generating elements corresponding to energized the electrode wires to generate heat. The thermal head 205 transmits the neat generated by the heat-generating element to an ink ribbon 207 and thereby, sublimates and transfers sublimable dye ink to the recording medium. In this manner, the thermal head 205 performs a recording operation on the recording medium.

The platen 206 is of a cylindrical shape and oriented such that the axis is parallel to the short edge the recording medium. The platen 206 is disposed enabling rotation about the axis. As the platen 206 passively rotates, following the movement of the recording medium in contact with the platen 206, the platen 206 receives the force applied to the recording medium by the thermal head 205 opposing the platen 206 across the recording medium.

The recording unit 204 has a ribbon unit 208. The ribbon unit 208 has a pair of rollers 209 and 210 that hold the ink ribbon 207. The paired rollers 209 and 210 are the takeup roller 209 and the feeding roller 210. The takeup roller 209 is disposed enabling rotation, and rotates in the clockwise direction with respect to FIG. 2 to take up from one side of the ink ribbon 207, the ink ribbon 207 held by the feeding roller 210. As the takeup roller 209 rotates to take up the ink ribbon 207, the feeding roller 210 rotates in the clockwise direction with respect to FIG. 2 to feed the ink ribbon 207 from the outer peripheral aspect of the ink ribbon 207.

The paired rollers 209 and 210 hold the ink ribbon 207 such that the ink ribbon 207 passes between the thermal head 205 and the platen 206. The paired rollers 209 and 210 hold the ink ribbon 207 to be between the thermal head 205 and the platen 206, in a state where the ink layers of the ink ribbon 207 face the platen 206.

In the printer unit 101, a flap 211 is disposed between a connection position between the first recording medium, holding unit 201 and the first recording medium, transportation path 202. When simplex printing is executed, the flap 211 guides the rolled paper P1 from the first recording medium, holding unit 201 to the first recording medium transportation path 202. When duplex printing is executed, the flap 211 guides the transportation of the recording medium P so that a cut sheet P2, which is a recording medium for duplex printing and is being transported from the simplex print ejection outlet 104 toward the thermal head 205, does not enter the first recording medium holding unit 201.

In the printer unit 101, a first cutter mechanism (first cutting unit) 212 is disposed near the simplex print ejection outlet 104. The first cutter mechanism 212 has a fixed cutter whose position is fixed, and a movable cutter that is in contact with the fixed cutter and is disposed at a position intersecting the first recording medium transportation path 202 (no reference numerals are assigned to cutters). The movable cutter is of a disc shape having a blade on the outer periphery and is disposed to be movable (reciprocative) along the fixed cutter, in a direction parallel to the short edge of the recording medium. When the movable cutter is in a stationary state during which the movable cutter stands by ready to cut the recording medium, the movable cutter is position such that the movable cutter does not hamper the passage of the recording medium.

The first cutter mechanism 212 has a driving source, such as a motor for the movable cutter, and a power transmission mechanism (not depicted) that transmits to the movable cutter, a driving force that is generated by the motor for the movable cutter. The first cutter mechanism 212 cuts the recording medium P in such a way that when the recording medium P is transported to a location at which a cutting position (cut position) of the recording medium P matches a position, at which the movable cutter moves to traverse (reciprocate across) the first recording medium transportation path 202 (i.e., cutting position for cutting by the first cutter mechanism 212), the movable cutter is moved in the width direction of the recording medium P by a driving force generated by the motor for the movable cutter.

The printer unit 101 includes a grip roller (first roller) 213 and a pinch roller (second roller) 214. The grip roller 213 has a projection projecting toward the outer periphery of the grip roller 213. The grip roller 213 comes in contact with the back side opposite to the recording surface of the recording medium P during a recording operation on the recording medium P by the recording unit 204. The pinch roller 214 is disposed opposite to the grip roller 213 across the first recording medium transportation path 202.

The grip roller 213 and the pinch roller 214 hold the recording medium P, the recording medium P being transported through the first recording medium transportation path 202.

By ensuring that the force (gripping force) that the grip roller 213 and the pinch roller 214 exert to hold and transport the recording medium is sufficiently larger than a load applied by the recording unit and paper transportation path to the recording medium, slipping of the grip roller 213 over the recording medium P can be prevented.

The grip roller 213 is rotated while the grip roller 213 and the pinch roller 214 hold the recording medium P between them. This action controls the position of the recording medium P relative to a recording position at which a recording operation is performed by the thermal head 205 and the platen 206. In the embodiments, a position control unit can be realized by the grip roller 213 and the pinch roller 214.

In the printer unit 101, a first storage unit 215 is disposed at a position that is near the simplex print ejection outlet 104 and beneath the first cutter mechanism 212 when the printer 100 is in the installed state. The first storage unit 215 has an opening that is located on an upper aspect when the printer 100 is in the installed state. Margins cut off by the cutting operation of the first cutter mechanism 212 are collected through the opening and stored in the first storage unit 215.

The first storage unit 215 can be attached/detached to/from the enclosure 101*a* of the printer unit 101. By detaching the first storage unit 215 from the enclosure 101*a* of the printer unit 101, a user of the printer 100 can easily dispose of margins cut off by the cutting operation of the first cutter mechanism 212.

The paper-feeding/paper-reversing unit 102 operates on power supplied from the power supply included in the printer unit 101. The paper-feeding/paper-reversing unit 102 has a second recording medium holding unit 216. The second recording medium holding unit 216 holds the recording medium P, which is suitable for duplex recording and has recording layers formed on both sides of the substrate. The second recording medium holding unit 216 holds the sheet-like recording media P in a stacked state. Hereinafter, the recording medium held by the second recording medium holding unit 216 will be referred to as "cut sheet" on a necessary basis and be denoted by P2 in the description.

The paper-feeding/paper-reversing unit 102 includes a second recording medium transport path 217. The second, recording medium transportation path 217 is formed between the first recording medium transportation path 202 and the second recording medium holding unit 216 in the printer unit 101, and extends from the second recording medium holding unit 216 to the first recording medium transportation path 202. The paper-feeding/paper-reversing unit 102 also includes paper transporting rollers 218A and 218C that transport the recording medium P in the second recording medium transport path 217, in a direction in which the recording medium P travels from the second recording medium holding unit 216 toward the first recording medium transportation path 202.

The paper-feeding/paper-reversing unit 102 includes a sheet feeding mechanism (sheet feeding unit) 219. The sheet feeding mechanism 219 picks the sheet-like recording media P (cut sheets P2) held by the second recording medium holding unit 216 one by one and feeds a picked recording medium P to the second recording medium transportation path 217. The sheet feeding mechanism 219 has a paper picking/sending off roller 220 and a paper separating unit (friction sheet) 221.

The paper picking/sending off roller 220 comes in contact with the recording medium P located at the uppermost level (hereinafter, referred to as "uppermost paper" as appropriate) among the recording media P (cut sheets P2) held by the second recording medium holding unit 216. The paper picking/sending off roller 220 is made of, for example, silicon, rubber. The sheet feeding mechanism 219 has an bias-applying mechanism 222 that continues to supply a bias to the paper picking/sending off roller 220 so that the paper picking/sending off roller 220 comes in contact with the uppermost paper regardless of the volume (number) of recording media held by the second recording medium holding unit 216.

In the embodiments, the paper picking/sending off roller 220, the paper transporting rollers 218A, and the paper separating unit (friction sheet) 221 respectively have irregular surfaces, smooth surfaces. Further, the paper picking/sending off roller 220, the paper transporting rollers 218A, and the paper separating unit (friction sheet) 221 may have a non-smooth surface on which a recession or projection is formed. For example, the surface of each of the paper picking/sending off roller 220, the paper transporting rollers 218A, and the paper separating unit (friction sheet) 221 is formed into a non-smooth shape by performing an embossing process, stiff-skin processing, etc., on the surface.

When the recording media P (cut sheets P2) held by the second recording medium holding unit 216 are fed to the second recording medium transportation path 217, the paper picking/sending off roller 220 is rotated about a shaft in the counterclockwise direction in FIG. 2 as the paper picking/sending off roller 220 is kept in contact with the uppermost paper. As a result, a frictional force created between the paper picking/sending off roller 220 and the uppermost paper causes the uppermost paper whose front end is indicated on the right edge in FIG. 2, to move to the second recording medium transportation path 217.

At this time, friction occurs between the recording medium P (cut sheet P2) that is the uppermost paper and the recording medium P (cut sheet P2) below the uppermost paper and between other recording media P (cut sheets P2) stacked, below the uppermost paper. This friction causes multiple recording media P (cut sheets P2) to start moving simultaneously toward, the second recording medium transportation path 217. Because the second recording medium holding unit 216 is provided with the paper separating unit (friction sheet) 221 indicated on the right side of the page surface in FIG. 2, each of the multiple recording media P (cut sheets P2) caused to move toward the second recording medium transportation path 217 by the rotation of the paper picking/sending off roller 220 comes in contact with the paper separating unit (friction sheet) 221, which exerts a restrictive force that restricts the movement of the multiple recording media P (cut sheets P2) that are about to move toward the second recording medium transportation path 217. Hence, the multiple recording media P (cut sheets P2) are prevented, from moving.

The material or the surface shape of the paper picking/sending off roller 220 is adjusted so that a frictional force acting between the recording medium P (cut sheet P2) and the paper picking/sending off roller 220 becomes larger than a frictional force acting between the edge of the recording medium P (cut sheet P2) and the paper separating unit (friction sheet) 221. The material or the surface shape of the paper separating unit (friction sheet) 221 is adjusted, so that the frictional force acting between the edge of the recording medium P (cut sheet P2) and the paper separating unit (friction sheet) 221 becomes larger than a frictional force acting between the other recording media P.

In this manner, the sheet feeding mechanism 219 is able to feed the uppermost paper in direct contact with the paper picking/sending off roller 220 alone, among the multiple recording media P (cut sheets P2) caused to move toward the second recording medium, transportation path 217 by the rotation of the paper picking/sending off roller 220, from the second recording medium holding unit 216 to the second recording medium transportation path 217.

A second paper sensor 223 is disposed near a boundary position between the second recording medium holding unit 216 and the second recording medium transportation path 217. An output value from the second paper sensor 223 changes depending on the presence and absence of the recording medium P fed from the second recording medium holding unit 216 to the second recording medium transportation path 217. For example, similar to the first paper sensor 203, the second paper sensor 223 can be realized in the form of, for example, a microswitch or photosensor.

The paper-feeding/paper-reversing unit 102 includes a third recording medium transportation path 224, which partially overlaps the second recording medium transportation path 217. The third recording medium transportation path 224 is of a loop shape in which both ends thereof are continuous with the first recording medium transportation path 202. The paper-feeding/paper-reversing unit 102 includes paper transfer rollers 218B that transport the recording medium ejected from the first recording medium transportation path 202 to the third recording medium transportation path 224, in a direction in which the recording medium, is fed through, the third recording medium transportation path 224 back to the recording medium transportation path 202.

Because of the loop shape of the third, recording medium transportation path 224, the recording medium P ejected from the first recording medium transportation path 202 to the third recording medium transportation path 224 is transported through the third recording medium transportation path 224 by the paper transporting rollers 218B and 218C and is fed back to the recording medium transportation path 202. As the recording medium P is transported through the third recording medium transportation path 224, the side of the recording medium P exposed for recording is switched, relative to the recording position of the recording unit 204 (position facing the heat-generating elements of the thermal head 205), and then the recording medium P is fed back to the first recording medium transportation path 202. In the printer 100 of the embodiments, a recording medium reversing unit is realized by the third recording medium transportation path 224, the paper transporting rollers 218B and 218C that transport the recording medium P through the third recording medium transportation path 224, and a mechanism, that gives a driving force to the paper transporting rollers 218B and 218C.

Among the paper transporting rollers, the paper transporting rollers 218B located, at a position reached by the recording medium during a recording operation can be moved to a position at which the transporting rollers 218B do not touch the recording medium P during the recording operation. For example, a mechanism is provided that swings the position of the transporting rollers 218B, interlocked move with a gear train between the transporting rollers 218B and a motor (the motor and gear train are not depicted). Through, this mechanism, when the motor giving a driving force to the transporting rollers 218B rotates in the direction of transportation of the recording medium P, one roller of the transporting rollers 218B that follows the other roller to rotate (press roller) is pressed against the recording medium P. When the motor rotates in reverse to the above direction, the follower roller moves away from the recording medium P. The paper transporting rollers 218B are retreated in this manner.

The paper picking/sending off roller 220 and the paper transporting rollers 218A, 218B and 218C can be driven by one motor by switching the rotation direction of the motor if a one-way clutch that idles to cut off a driving power when the motor rotates in reverse is inserted between the motor that generates the driving power and each gear train reaching each of rollers. In such a case, it is preferable to give a proper amount of backlash (play) to a gear train between the motor and the paper picking/sending off roller 220. By giving this backlash, even if the motor for the paper transporting roller 218B is rotated in reverse until the paper transporting roller 218B reaches its retreat position after the side of the recording medium P (cut sheet P2) to be recorded is switched, the recording medium P (cut sheet. P2) held, by the second recording medium holding unit 216 is not sent off.

Among the paper transporting rollers 218 included in the paper-feeding/paper-reversing unit 102, the paper transporting rollers 218C disposed at a position passed by the recording medium P whose side to be recorded as been switched serves also as cleaning rollers. The paper transporting rollers 218C serving also as the cleaning rollers transport the recording medium P and also exert the function of a cleaning unit that cleans the face (back side) of the recording medium P on which a recording operation is performed when the recording medium P is fed back to the printer unit 101.

The third recording medium transportation path 224 is provide with a flap 225 disposed on the part where the third recording medium transportation path 224 overlaps the second recording medium transportation path 217. The flap 225 guides the recording medium P ejected from the first recording medium transportation path 202 to the third recording medium transportation path 224 to determine the transportation position of the recording medium P in the third recording medium transportation path 224. The flap 225 is shifted to different respective positions for a case where the recording medium P2 is ejected from the first recording medium transportation path 202 to the third recording medium transportation path 224 and for a case where the recording medium P is fed from the third recording medium transportation path 224 to the first recording medium transportation path 202 (see FIGS. 2 and 4).

For example, the flap 225 is shifted to a position indicated in FIG. 2 in a case where the recording medium P2 is ejected from the first recording medium transportation path 202 to the third recording medium transportation path 224. For example, the flap 225 is shifted to a position indicated in FIG. 4 in a case where the recording medium P is fed from the third recording medium transportation path 224 to the first recording medium transportation path 202.

The paper-feeding/paper-reversing unit 102 includes a fourth recording medium transportation path 226. The fourth recording medium transportation path 226 is formed between the duplex print ejection outlet 105 leading to the second recording medium ejection position and the end of the first recording medium, transportation path 202 that is closer to the paper-feeding/paper-reversing unit 102, and extends from the first recording medium transportation path 202 to the duplex print ejection outlet 105. The paper-feeding/paper-reversing unit 102 includes paper transfer rollers 218D and 218E that transport the recording medium P ejected from the first recording medium transportation path 202 into the fourth recording medium transportation path 226, in a direction in which the recording medium P travels from the first recording medium transportation path 202 toward the duplex print ejection outlet 105.

The recording medium P ejected from the first recording medium transportation path 202 into the fourth recording medium transportation path 226 is subjected to a transportation force of the paper transfer rollers 218D and 218E as the recording medium P is kept held between the grip roller 213 and the pinch roller 214. The recording medium P is thus transported in a direction of traveling through the duplex print ejection outlet 105 to be ejected out of the paper-feeding/paper-reversing unit 102. In the embodiments, the paper transfer rollers 218D and 218E, the grip roller 213, and the pinch roller 214 jointly realize a recording medium, ejecting unit that transports the recording medium ejected from the first recording medium transportation path 202 into the fourth recording medium transportation path 226, to a position outside the paper-feeding/paper-reversing unit 102 (second recording medium ejection position) through the duplex print ejection outlet 105.

A flap 227 is disposed, on a part of the third recording medium transportation path 224 that overlaps the second recording medium transportation path 217 and that is at a boundary position between the third recording medium transportation path 224 and the fourth recording medium transportation path 226. The flap 227 guides the recording medium ejected from the printer unit 101 through the first recording medium transportation path 202 to the paper-feeding/paper-reversing unit 102 to determine the transportation position of the recording medium. The flap 227 is selectively shifted to a position at which the flap 227 prevents the recording medium ejected from the printer unit 101 through the first, recording medium transportation path 202 to the paper-feeding/paper-reversing unit 102 from entering the fourth recording medium transportation path 226 (see FIGS. 2, 3, and 4), or to a position at which the flap 227 guides the recording medium to the fourth recording medium transportation path 226 (see FIG. 5).

In the paper-feeding/paper-reversing unit 102, a second cutter mechanism (second cutter unit) 228 is disposed near the duplex print ejection outlet 105. The second cutter mechanism 228 is disposed at a location at which the distance between the cutting position of the second cutter mechanism 228 and the paper transporting rollers 218, such as grip roller 213, of the printer unit 101 is shorter than the length of the minimum recorded object that can be recorded on the recording medium P2 in the printer 100.

The second cutter mechanism 228 is identical in configuration to the first cutter mechanism 212, and has a fixed cutter whose position is fixed and a movable cutter disposed opposite to the fixed cutter across the second, recording medium transportation path 217 (no reference numeral is appended to the cutters). Because the second cutter mechanism 228 is identical in configuration to the first cutter mechanism 212, further description of the second cutter mechanism 228 will be omitted.

In the printer 100 of the embodiments, the flap 227 is operated by a driving force of a motor that drives the paper transporting rollers 218D and 218E disposed on the fourth recording medium transportation path 226. This motor for driving the flap 227 drives the paper transporting rollers 218D and 218E disposed on the fourth recording medium transportation path 226 and also drives the flap 227.

For example, a pivot on which the flap 227 revolves is provide with a gear, and this gear is engaged with a gear train that drives the paper transporting rollers 218D and 218E on the ejection side, via a clutch mechanism (torque limiter), which, is not depicted. In this configuration, when the motor is driven to rotate the paper transporting rollers 218D and 218E in a direction of ejecting the recording medium P through the fourth, recording medium, transportation path 226, the flap 227 moves in a direction of ejecting the recording medium P out of the duplex print ejection outlet 105 (position of the flap 227 indicated, in FIG. 5). When the motor is driven to rotate the paper transporting rollers 218D and 218E in the direction reverse to the direction of ejecting the recording medium P through the fourth recording medium transportation path 226, the flap 227 moves in a direction of guiding the recording medium P to the third recording medium transportation path 224 (position of the flap 227 indicated, in FIG. 2).

In the paper-feeding/paper-reversing unit 102, a second storage unit 229 is disposed at a position that is near the duplex print ejection outlet 105 and beneath the second cutter mechanism 228 when the printer 100 is in the installed state. The second storage unit 229 has an opening that is located on an upper aspect when the printer 100 is in the installed state. Margins cut off by the cutting operation of the second cutter mechanism 228 are collected through the opening and stored in the second storage unit 229.

The second storage unit 229 can be attached/detached to/from the enclosure 101*a* of the paper-feeding/paper-reversing unit 102. By detaching the second storage unit 229 from the enclosure 101*a* of the paper-feeding/paper-reversing unit 102, the user of the printer 100 can easily dispose of the margins cut off by the cutting operation of the second cutter mechanism 228.

The printer 100 of the embodiments may be configured to cause one motor to execute the operation (picking/sending off operation) of feeding the sheet-like recording medium P (cut sheet P2) held by the second recording medium holding unit 216 to the second recording medium transportation path 217 and the operation of transporting the recording medium P (cut sheet P2) fed to (picked, and sent to) the second, recording medium transportation path 217, from the paper-feeding/paper-reversing unit 102 to the printer unit 101.

For example, the above configuration can be realized by placing a one-way clutch in a gear train connected to the paper picking/sending off roller 220 that feeds the recording medium P (cut sheet P2) to the second, recording medium transportation path 217 and in each of gear trains connected to the paper transporting rollers 218A, 218B, and 218C that transfer the recording medium P from the paper-feeding/paper-reversing unit 102 to the printer unit 101. When the paper picking/sending off roller 220 is driven, the one-way clutch in each of the gear trains connected, to the paper transporting rollers 218A, 218B, and 218C idles and thus, transmits no driving force. When paper transporting rollers 218A, 218B, and 218C are driven, the one-way clutch in the gear train connected to the paper picking/sending off roller 220 idles and thus, transmits no driving force.

In this manner, in the second recording medium transportation path 217 and the third recording medium transportation path 224, multiple operations, such as picking/sending off the recording medium P2 or not picking/sending off the recording medium P but transporting the recording medium P, can be performed selectively by one motor through switching of the direction of rotation of the motor that drives the sheet feeding mechanism 219.

(Hardware Configuration of Printer 100)

Figure 6:
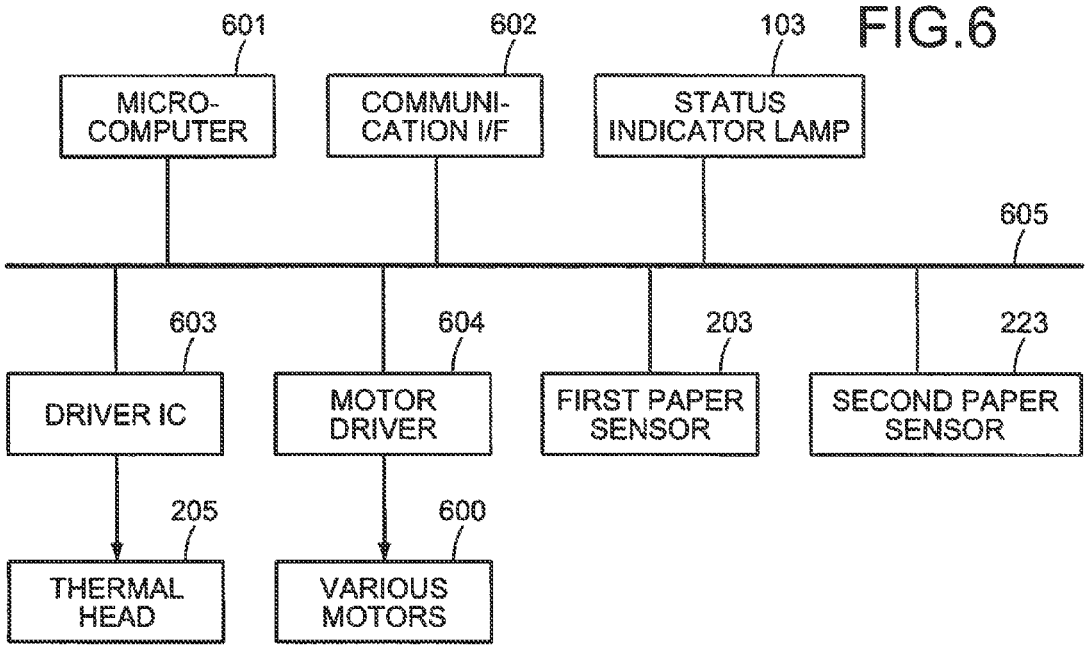
FIG. 6 is an explanatory diagram of a hardware configuration of the printer of the embodiments.
Figure 7:
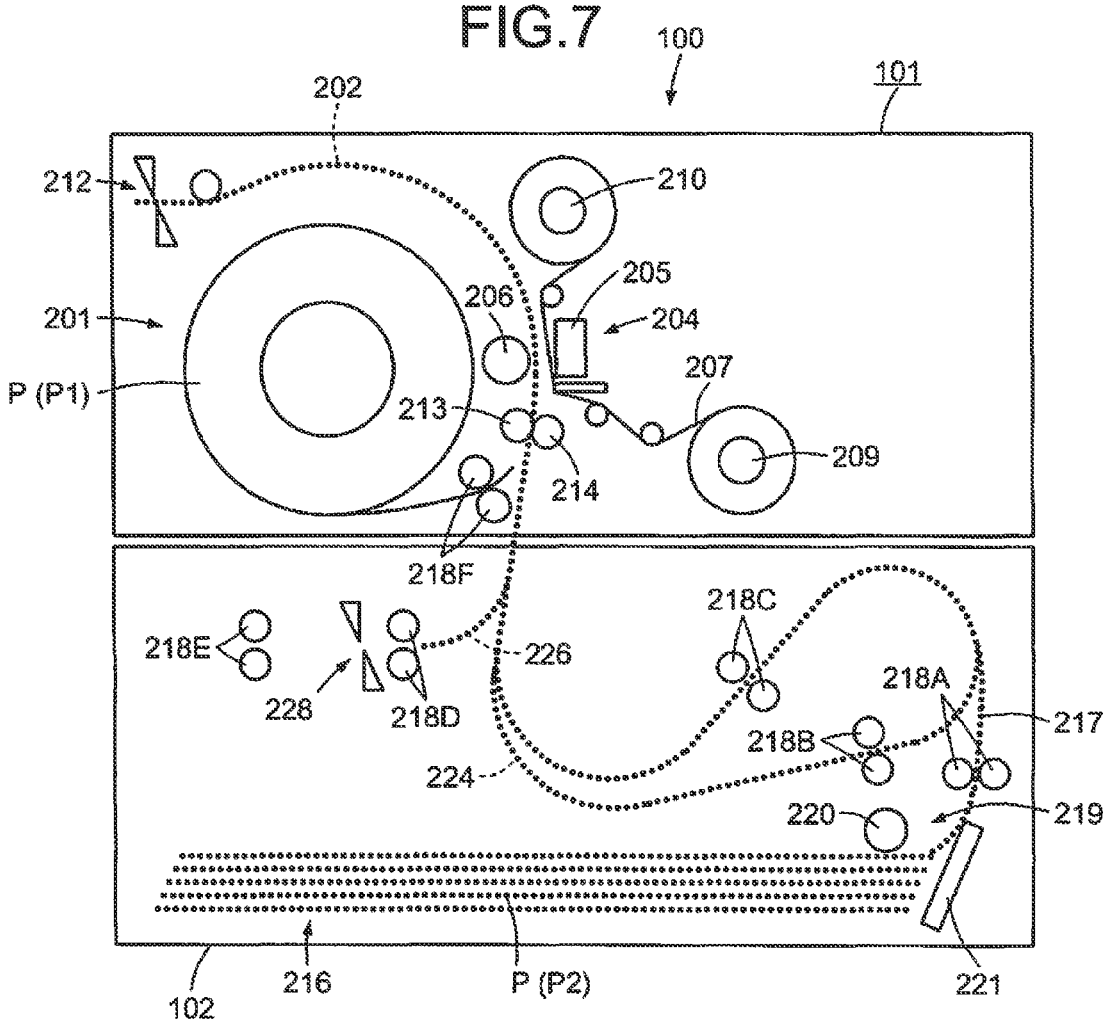
FIGS. 7, 8, 9, 10, and 11 are explanatory diagrams of a recording operation performed by the printer for simplex recording.
Figure 8:
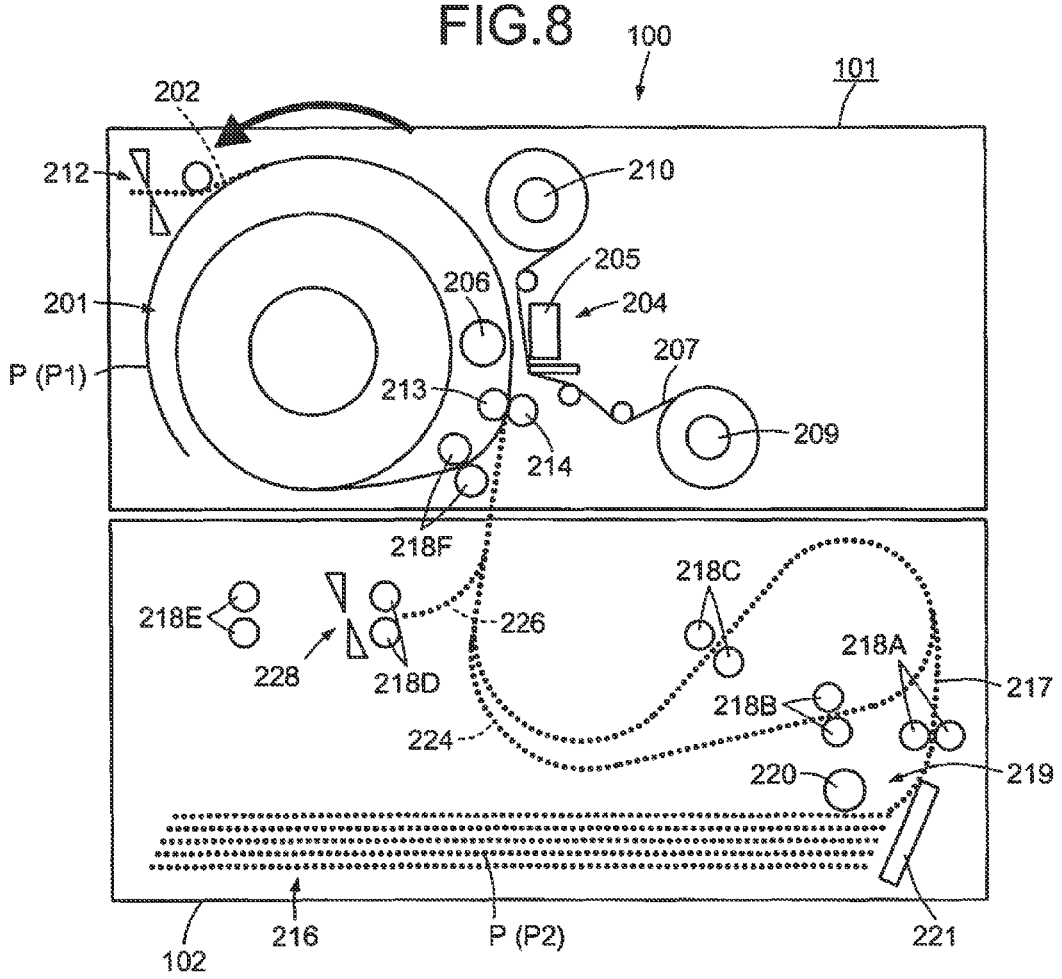
Figure 9:
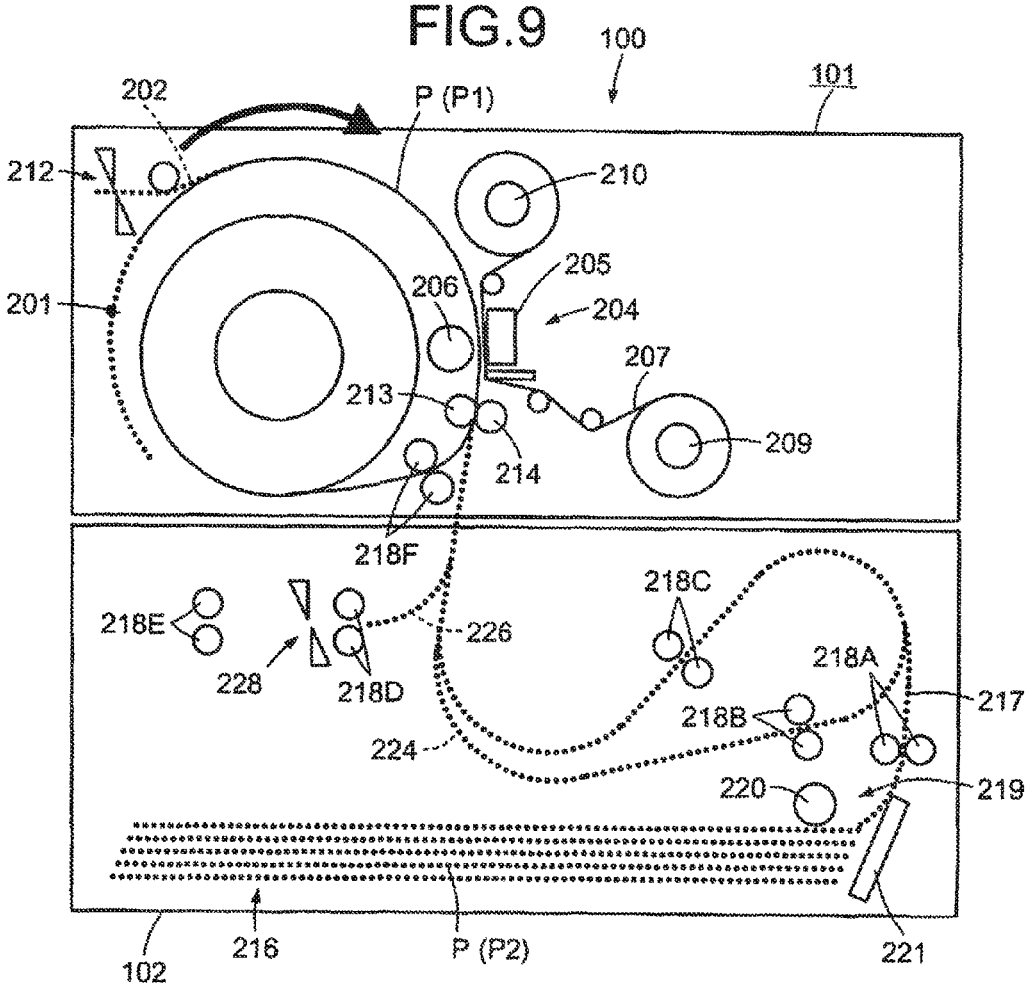

A hardware configuration of the printer 100 of the embodiments will be described. FIG. 6 is an explanatory diagram of the hardware configuration of the printer 100 of the embodiments. In FIG. 6, the printer 100 includes a microcomputer 601, a communication interface (I/F) 602, a driver IC 603, a motor driver 604, the status indicator lamp 103, the first paper sensor 203, and the second paper sensor 223. The microcomputer 601, the communication interface (I/F) 602, the driver IC 603, the motor driver 604, the status indicator lamp 103, the first paper sensor 203, and the second, paper sensor 223 are interconnected through a bus 605.

The microcomputer 601 drives and controls each of the components included in the printer 100. The microcomputer 601 can be realized by, for example, a CPU, memory, such as ROM and RAM, and a board carrying various circuits, such as an input/output circuit and timer circuit. In the printer 100 of the embodiments, the microcomputer 601 realizes a control unit that drives and controls each of the units included in the printer 100 and each of the units included in the paper-feeding/paper-reversing unit 102.

The microcomputer 601 drives and controls each of the units included in the printer 100 by causing the CPU to execute various control programs stored in a memory, based on various data stored in the memory and various reception data sent from an external device through the communication I/F 602. In the microcomputer 601, the CPU uses the RAM as, for example, a work area onto which image data for printing is loaded based on recording command information.

The communication I/F 602 is connected to an external device (not depicted). The communication I/F 602 supervises interface between a network and the interior of the printer 100, and controls data input/output to/from the computer. The external device, for example, generates recording command information for the printer 100 and outputs the generated recording command, information to the printer 100. The recording command information includes, for example, information on an image to be recorded on the recording medium P and a command of recording the information. For example, the external device is realized in the form of a personal, computer installed in a store offering DPE services, at which a picture taken by a digital camera is printed out.

The driver IC 603 is driven and controlled by the microcomputer 601. The driver IC 603 driven, and controlled by the microcomputer 601 selectively energizes electrode cables respectively corresponding to multiple heat-generating elements of the thermal head 205. As a result, each of the heat-generating elements is selectively caused to generate heat. Heat generated by the heat-generating element of the thermal head 205 is transmitted to the recording layer of the recording medium via the ink ribbon 207, in which process sublimable aye ink in the ink ribbon 207 is sublimated and transferred to the recording medium. In this manner, a recording operation on the recording medium is performed.

The motor driver 604 is driven and controlled by the microcomputer 601. The motor driver 604 driven and controlled by the microcomputer 601 drives and controls various motors 600, such as the motor for the grip roller 213, the motor for the paper transporting rollers 218A, 218B, and 218C, the motor for the paper transporting rollers 218D and 218E, the motor for the movable cutter, and the motor for moving the thermal head 205. The motor for the grip roller 213, the motor for the paper transporting rollers 218A, 218B, and 218C, and the motor for the paper transporting rollers 218D and 218E are realized in the form of, for example, stepping motors. The motor for the movable cutter is realized in the form of, for example, a DC motor. The motor driver 604 can be provided for each of the motors, such as the motor for the grip roller 213, the motor for the paper transporting rollers 218, and the motor for the movable cutter.

The motor driver 604 drives and controls a motor to be driven, based on a control signal from the microcomputer 601, and switches energization sequences and directions of applied current of various motors 600. Various motors 600 are respectively driven and controlled by the motor driver 604 to convert electrical energy into mechanical energy and thereby, generate a rotary driving force. The directions of rotation of the various motors 600 are switched according to the switching of energization sequences and directions of applied current by the motor driver 604.

The status indicator lamp 103 is driven and controlled by the microcomputer 601, and turns on and off according to the status of the printer 100. The status indicator lamp 103 is realized in the form of, for example, an LED. The status indicator lamp 103 turns on and off in correspondence to report contents, such as the status of power supply to the printer 100, the presence/absence of an error at the printer 100, and the presence/absence of a recording medium.

For example, multiple status indicator lamps 103 may be provided for respective report contents. For example, the status indicator lamp 103 may emit light of different colors for respective report contents. For example, the status indicator lamp 103 may turn on and off for respective report contents to indicate different lighting patterns for respective report contents.

Output values from the first paper sensor 203 and the second paper sensor 223 are input to the microcomputer 601. Output values from the first paper sensor 203 and second paper sensor 223 may be constantly input to the microcomputer 601, or may be input to the microcomputer 601 only when an output value change occurs.

(Recording Operation Performed by Printer 100)

A recording operation performed by the printer 100 of the embodiments will then be described. As described above, the printer 100 can perform both simplex recording and duplex recording.

(Simplex Recording)

FIGS. 7, 8, 9, 10, and 11 are explanatory diagrams of a recording operation performed by the printer 100 (microcomputer 601) for simplex recording. The printer 100 stands by until receiving recording command information (simplex print data) giving a command of simplex recording from an external device (see FIG. 7). Upon receiving the simplex print data from the external device, the printer 100 starts the recording operation for simplex recording.

Upon receiving the simplex print data, the printer 100 drives and controls the motor driver 604 to be driven, and rotates the paper transporting rollers 218F corresponding to the motor driver 604 in a given direction. In this case, the printer 100 rotates the paper transporting rollers 218F disposed on the first recording medium transportation path 202 in a direction in which the recording medium in the first recording medium transportation path 202 travels from the first recording medium holding unit 201 toward the simplex print ejection outlet 104.

As a result, the recording medium P (rolled paper P1) held by the first recording medium holding unit 201 is pulled out from the first recording medium, holding unit 201 to the first, recording medium transportation path 202. When the recording medium P (rolled paper P1) is pulled out to the first recording medium transportation path 202, the printer 100 can determine whether the front end of the recording medium P (rolled paper P1) held by the first recording medium holding unit 201 is pulled out to the first recording medium transportation path 202 and is held between the grip roller 213 and the pinch roller 214, based on output values from the first paper sensor 203 and a paper sensor (not depicted) on the paper path 202.

Subsequently, the printer 100 drives and controls the motor driver 604 to be driven, and rotates the grip roller 213 corresponding to the motor driver 604 in a given direction. The printer 100 keeps pulling out the recording medium P (rolled paper P1) held by the first recording medium holding unit 201 into the first, recording medium transportation path 202 until the front end of the recording medium reaches a preset recording operation start position (print start position) (see FIG. 8).

The recording operation start position (print start position) can be set to a position at which the length between the front end of the recording medium P (rolled paper P1) pulled out to the first recording medium transportation path 202 and the recording position of the recording unit 204 is longer than the size of a recorded object specified by the received recording command information from the external device. When pulling the recording medium P (rolled paper P1) out of the first recording medium holding unit 201, the printer 100 causes the thermal head 205 to move away from the platen 206.

The printer 100 then causes the thermal head 205 to move closer to the platen 206 so that the thermal head 205 and the platen 206 hold the recording medium and the ink ribbon 207 therebetween. In this state, as the recording medium P (rolled paper P1) pulled out from the first recording medium holding unit 201 to the first recording medium transportation path 202 is transported in a direction in which the recording medium P is drawn into the first recording medium holding unit 201, the heat-generating elements of the thermal head 205 are selectively caused to generate heat, based on the recording command information (see FIG. 9). As a result, heat generated by the heat-generating elements is transmitted to the ink ribbon 207, and sublimable dye ink in the ink ribbon 207 is sublimated and transferred to the recording medium. In this manner, the recording operation on the recording medium is performed.

The above recording operation is performed for each color of each ink layer in a so-called YMC surface sequential printing process. For example, a recording operation for the first color (e.g., yellow (Y)) is performed first, which is followed by a recording operation for the second color (e.g., magenta (M)), which is then followed by a recording operation for the third color (e.g., cyan (C)). In each recording operation for each color, the printer 100 keeps pulling out the recording medium P (rolled paper P1) to the first recording medium transportation path 202 until the front end of the recording medium P (rolled paper P1) drawn into the first recording medium holding unit 201 during the recording operation reaches the recording operation start position again (see FIG. 8).

For example, after performing the recording operation for the first color (e.g., yellow (Y)), the printer 100 keeps pulling out the recording medium P (rolled paper P1) to the first recording medium transportation path 202 until the front end of the recording medium P reaches the recording operation start position. The printer 100 then performs the recording operation for the second color (e.g., magenta (M)), and after finishing the recording operation, keeps pulling out the recording medium P (rolled paper P1) to the first recording medium transportation path 202 until the front end of the recording medium P reaches the recording operation start position. The printer 100 performs the recording operation for the third color (e.g., cyan (C)) in the same manner.

After each recording operation for each color is performed on a single side of the recording medium P, an overcoat layer is formed on the recording surface on which the recording operation is performed. As the recording medium P (rolled paper P1) is pulled out to the first recording medium transportation path 202 until the front end of the recording medium P subjected to the recording operation reaches the recording operation start position, the printer 100 performs the recording operation to form the overcoat layer on the recording surface on which the recording operation is performed. The overcoat layer is formed to cover the entire recording surface on which the recording operation has been performed.

The printer 100 then drives and controls the motor driver 604 to be driven to rotate the grip roller 213 disposed on the first recording medium transportation path 202 in a direction in which the recording medium P (rolled paper P1) coated with the overcoat layer travels from the first recording medium holding unit 201 toward the simplex print ejection outlet 104. The printer 100 keeps driving and controlling the motor driver 604 until the front end of the recording medium P (rolled paper P1) coated with the overcoat layer is pulled out to pass the cutting position of the first cutter mechanism 212 and reach a given position.

Figure 10:
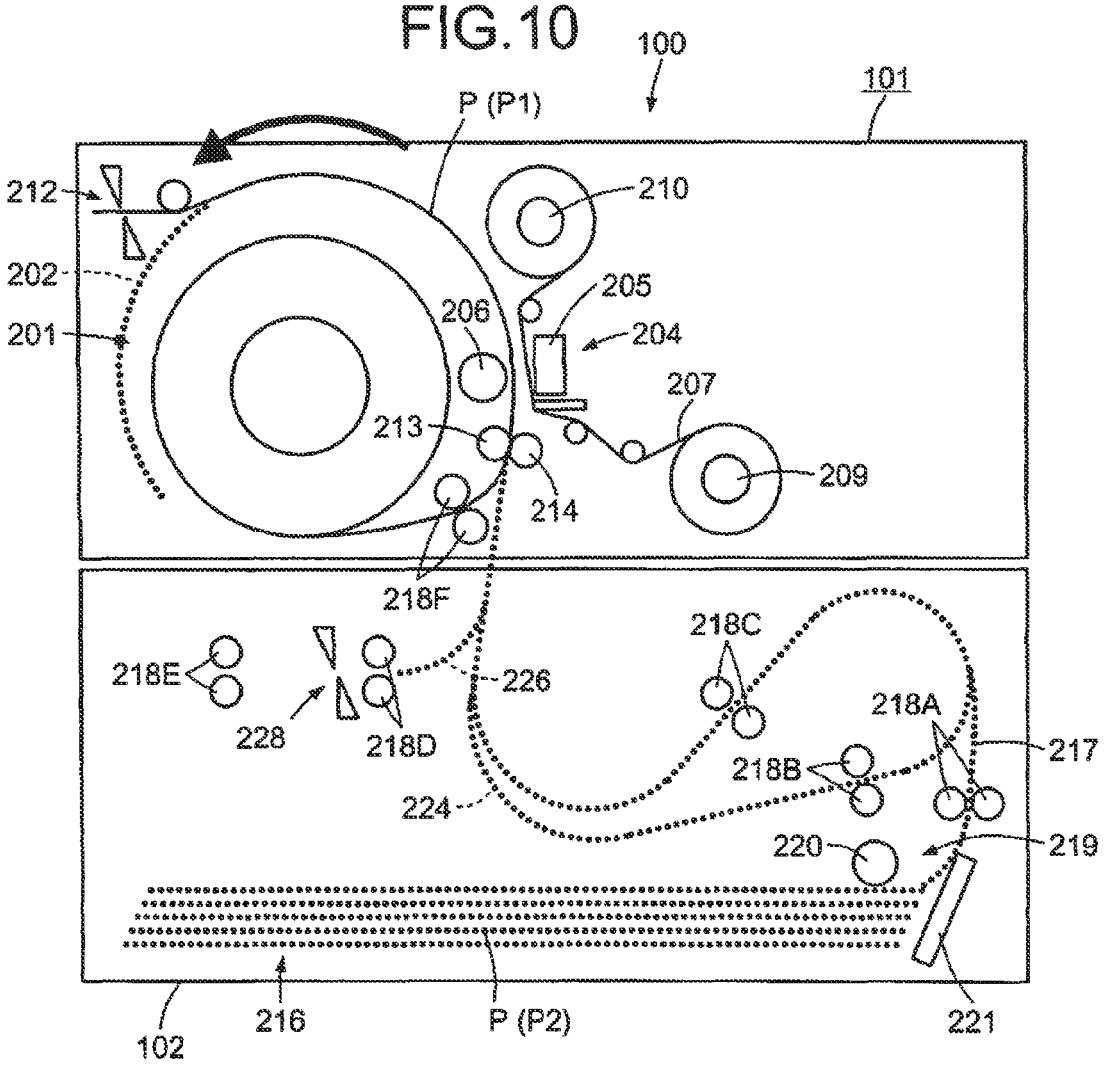

As the recording medium P (rolled paper P1) coated with the overcoat layer is pulled out to the given position, the motor driver 604 for the motor for the movable cutter of the first cutter mechanism 212 is driven and controlled to operate the movable cutter (see FIG. 10). As a result, a margin on the front end of the recording medium subjected to simplex recording is cut away from the recorded object and is stored in the first storage unit 215.

Then, the motor driver 604 is driven and controlled to rotate the grip roller 213 in a direction in which the recording medium P (rolled paper P1) subjected to simplex recording and having its front end margin cut away, is transported toward the simplex print ejection outlet 104. The printer 100 controls and drives the motor driver 604 until a recorded portion formed, by the recording unit 24 on the recording medium P (rolled paper P1) subjected to simplex recording is transported to pass the cutting position of the first cutter mechanism 212 and reaches a given position.

Figure 11:
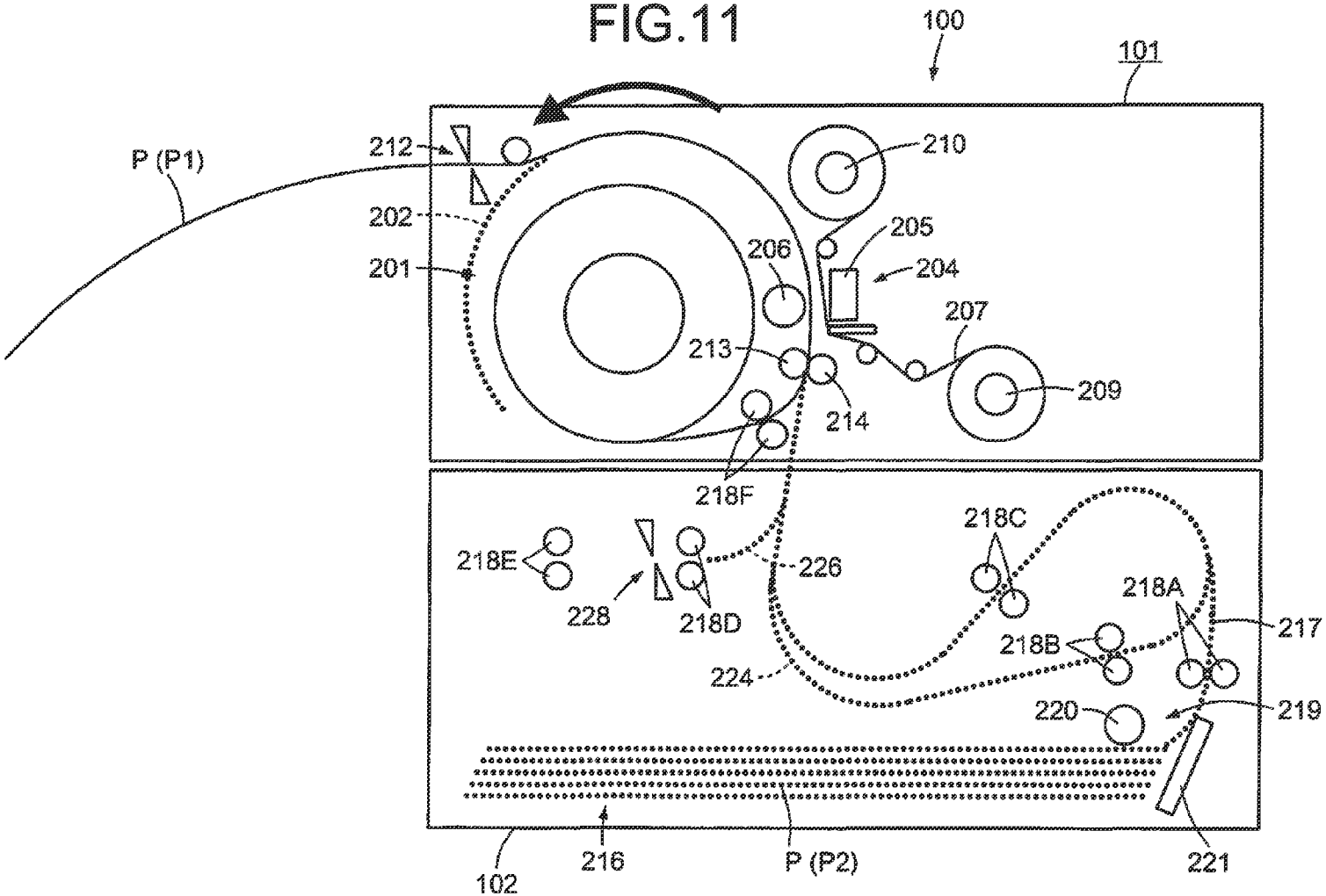
Figure 12:
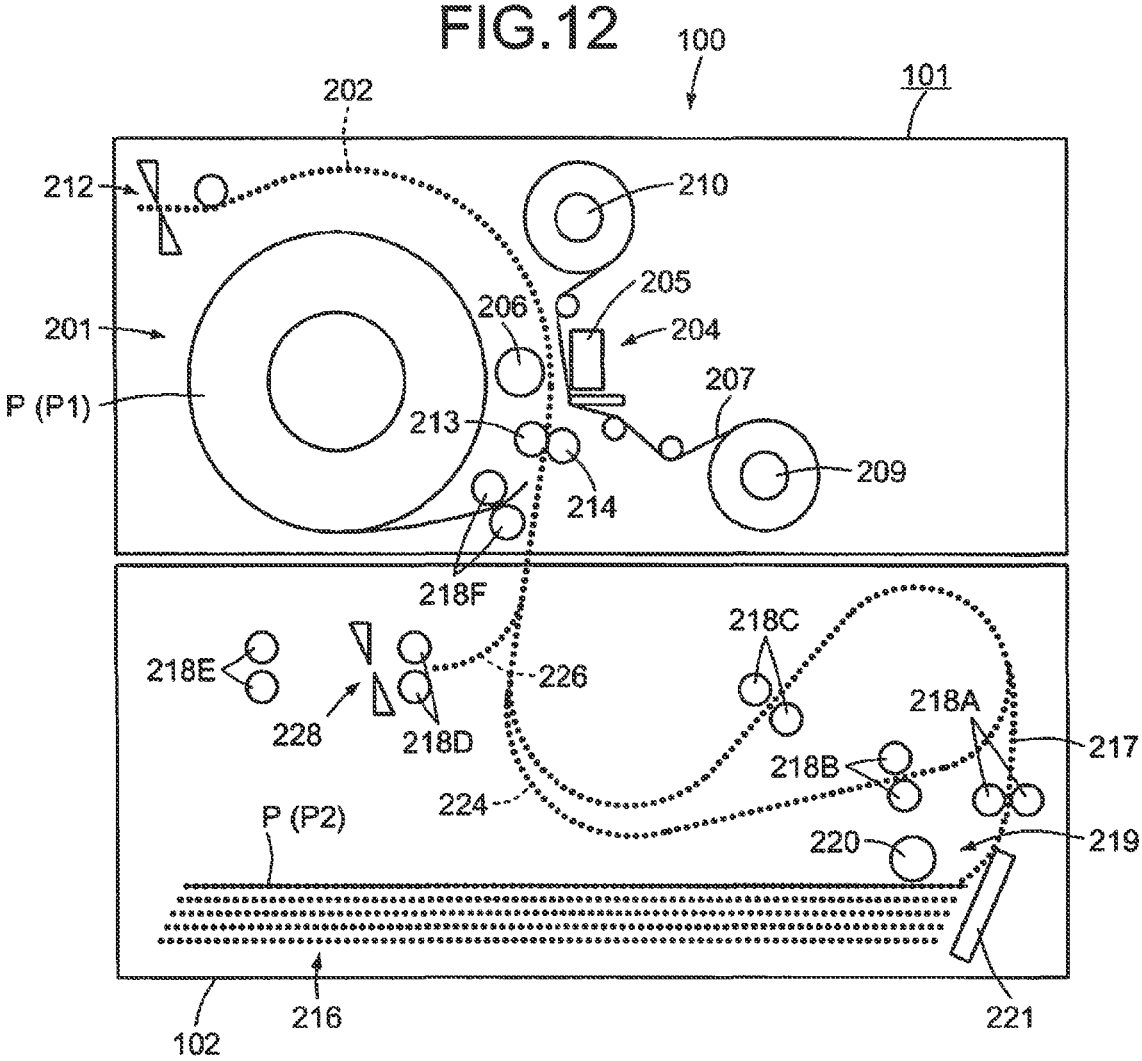
FIGS. 12, 13, 14, 15, 16, 17, 18, 19, 20, 21, and 22 are explanatory diagrams of a recording operation performed by the printer for duplex recording.
Figure 13:
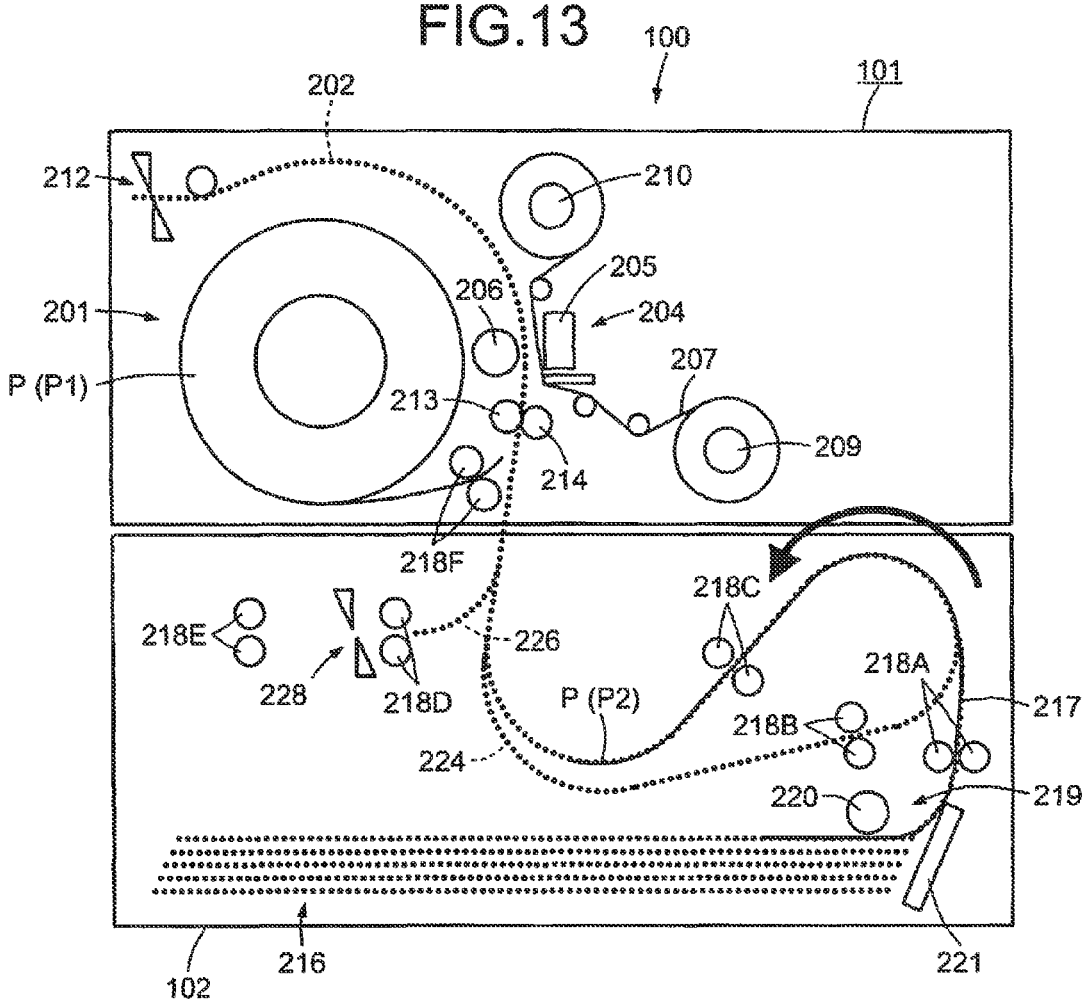
Figure 14:
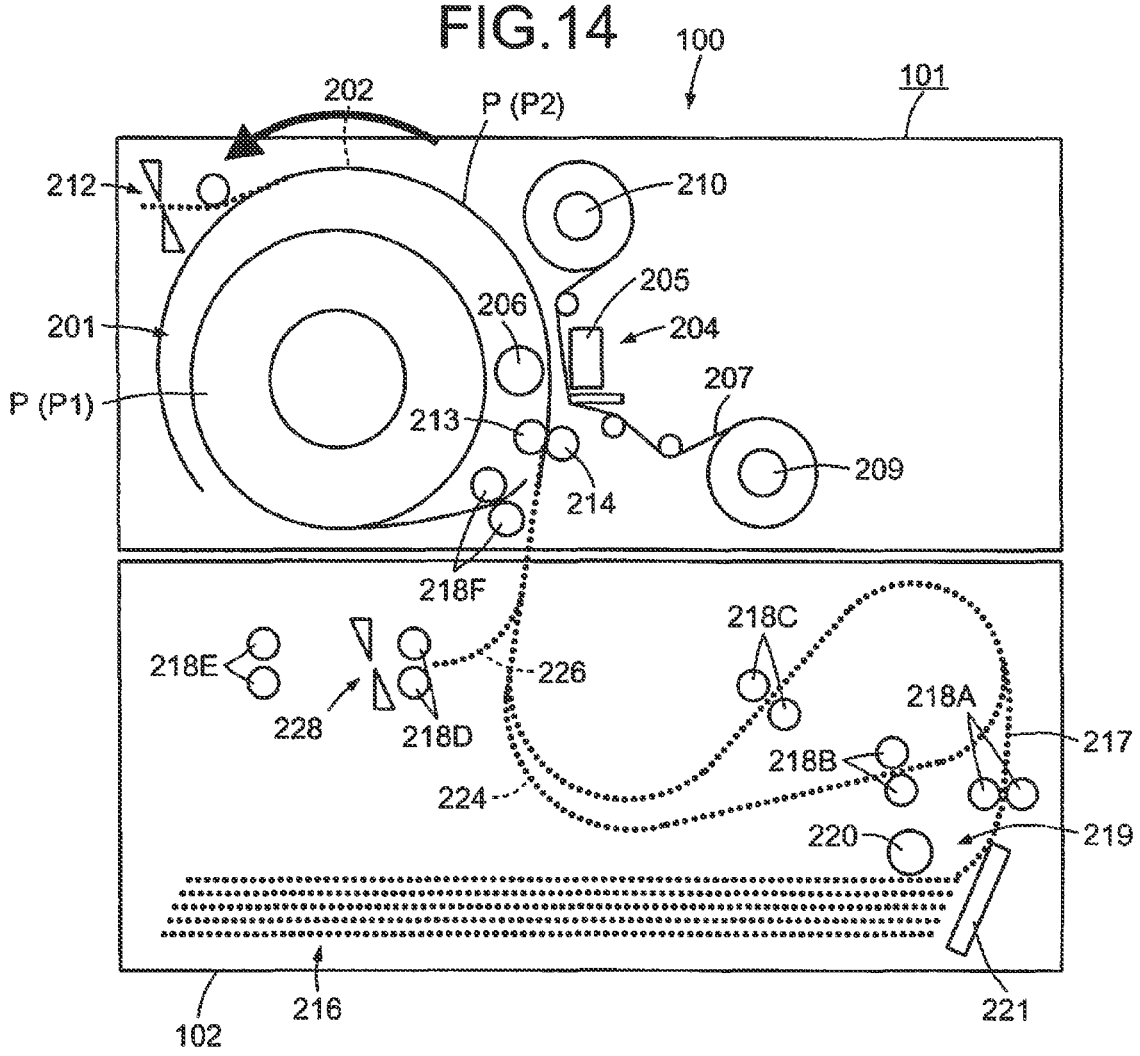
Figure 15:
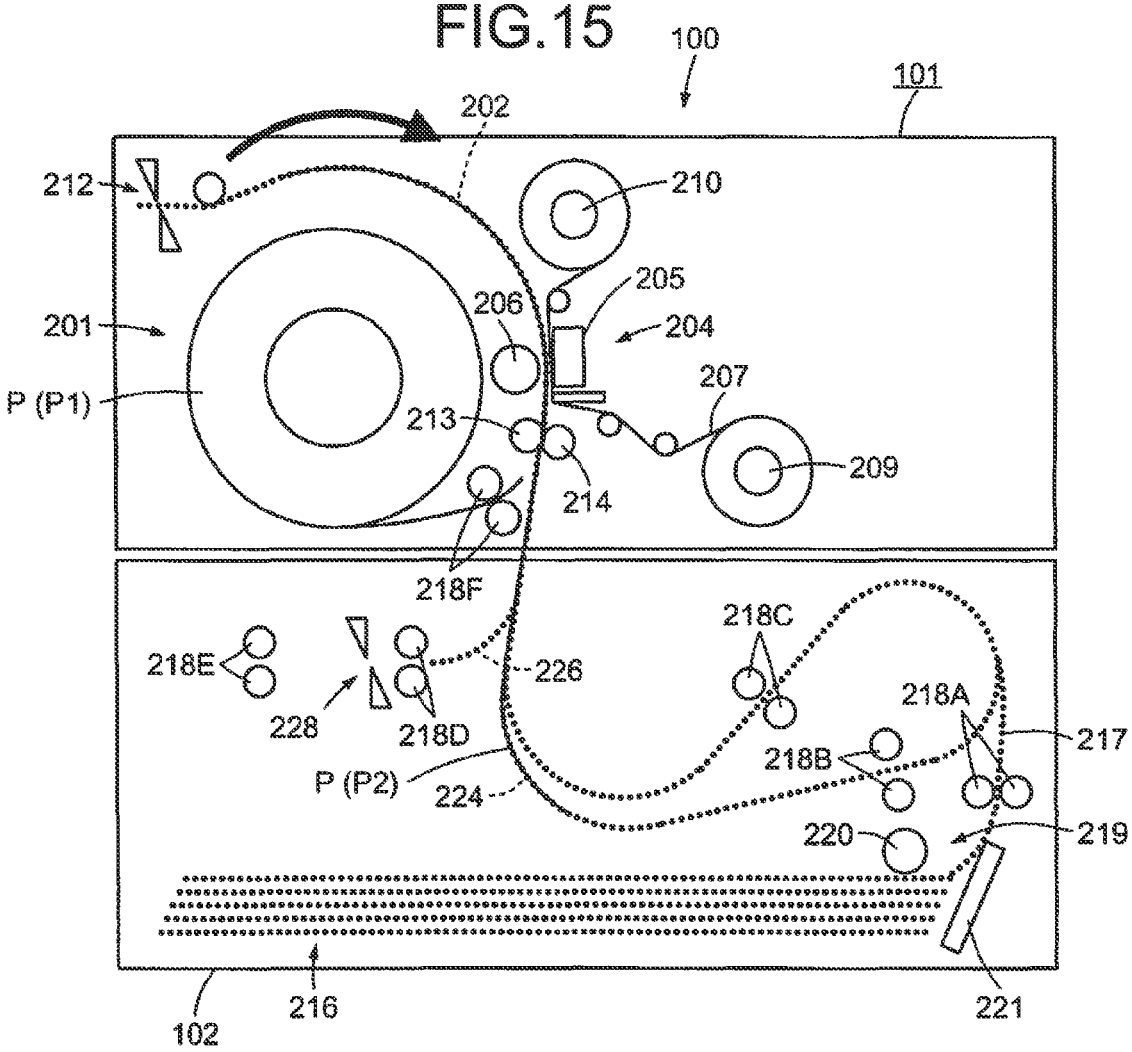

In this state, the motor driver 604 for the motor for the movable cutter of the first cutting unit is driven and controlled to actuate the movable cutter again (see FIG. 11). As a result, the recording medium subjected to simplex recording is cut along the boundary between the recorded portion, and an unrecorded portion. In this manner, both ends of the recorded portion of the recording medium subjected to simplex recording are cut away to provide a recorded object without margins (recorded object without a border).

FIGS. 12, 13, 14, 15, 16, 17, 18, 19, 20, 21, and 22 are explanatory diagrams of a recording operation performed by the printer 100 (microcomputer 601) for duplex recording. The printer 100 stands by until recording command information (duplex print data) giving a command of duplex recording from an external device is received (see FIG. 12). Upon receiving the duplex print data from the external device, the printer 100 starts the recording operation for duplex recording.

Upon receiving the duplex print data, the printer 100 drives and controls the motor driver 604 to be driven to drive and control the motor for the paper picking/sending off roller 220 corresponding to the motor driver 604, thereby rotates the paper picking/sending off rollers 220.

When the second sensor 223 detects a paper, the printer 100 drives and controls the motor driver 604 to be driven to drive and control the motor for the paper transporting rollers 218A and 218C corresponding to the motor driver 604, thereby rotates the paper transporting rollers 218A and 218C in a given direction.

In this case, the printer 100 rotates the paper transporting rollers 218A and 218C disposed on the second recording medium, transportation path 217 in a direction in which the recording medium in the second recording medium transportation path 217 travels from the second recording medium, holding unit 216 toward the first recording medium transportation path 202. As a result, the recording medium P (cut sheet P2) held by the second recording medium holding unit 216 is pulled out from the second recording medium holding unit 216 to the second recording medium transportation path 217 and travels through the second recording medium transportation path 217 into the first recording medium transportation path 202 (see FIG. 13).

In this case, the printer 100 drives and controls the motor driver 604 to be driven to rotate the grip roller 213 in a direction, in which the recording medium in the first recording medium transportation path 202 travels toward the simplex print ejection outlet 104. As a result, the recording medium P (cut sheet P2) held by the second recording medium holding unit 216 travels from the second recording medium holding unit 216 to reach the start position (print start position) (see FIG. 14). When the recording medium is pulled out from the second recording medium holding unit 216, the thermal head 205 is separated from the platen 206.

The printer 100 then causes the thermal head 205 to move closer to the platen 206 so that the thermal head 205 and the platen 206 hold the recording medium and the ink ribbon 207 therebetween, and causes the paper transporting rollers 218B to separate from each other so that the paper transporting rollers 218B retreat to a position at which they do not touch the recording medium during a recording operation. In this state, as the recording medium pulled out from the second recording medium holding unit 216 to the first recording medium transportation path 202 is transported in a direction in which the recording medium is drawn into the third recording medium holding unit, the heat-generating elements of the thermal head 205 are selectively caused to generate heat, based on the recording command information (see FIG. 15). As a result, heat generated by the heat-generating elements is transmitted to the ink ribbon 207, and sublimable dye ink in the ink ribbon 207 is sublimated and transferred to the recording medium. In this manner, the recording operation on a single side (surface) of the recording medium is performed.

After each recording operation for each color is performed on a single side (surface) of the recording medium P (cut sheet P2) in the same manner as in the above case of simplex recording, an overcoat layer is formed on the recording surface of the recording medium P (cut sheet P2) subjected, to simplex recording. In the same manner as in the above case of simplex recording, the overcoat layer is formed to cover the entire recording surface on which the recording operation is performed. After the completion of the recording operation on a single side (surface) of the recording medium, the thermal head 205 is separated from the platen 206.

Subsequently, the motor driver 604 to be driven is driven and controlled to rotate the paper transporting rollers 218B and 213C and the grip roller 213 in a direction of transporting the recording medium P (cut sheet P2) coated with the overcoat layer toward the third recording medium transportation path 224.

The printer 100 thus drives and controls the motor driver 604 to rotate the paper transporting rollers 218B and 213C and the grip roller 213 corresponding to the motor driver 604 in a given direction. In this case, the printer 100 rotates the paper transporting rollers 218B and 213C and the grip roller 213 disposed on the third, recording medium transportation path 224, in a direction in which the recording medium pulled into the third recording medium transportation path 224 is fed back to the first recording medium transportation path 202. At this time, the paper transporting rollers 218B is at a position at which the paper transporting rollers 218B in contact with the recording medium can transport the recording medium.

Figure 16:
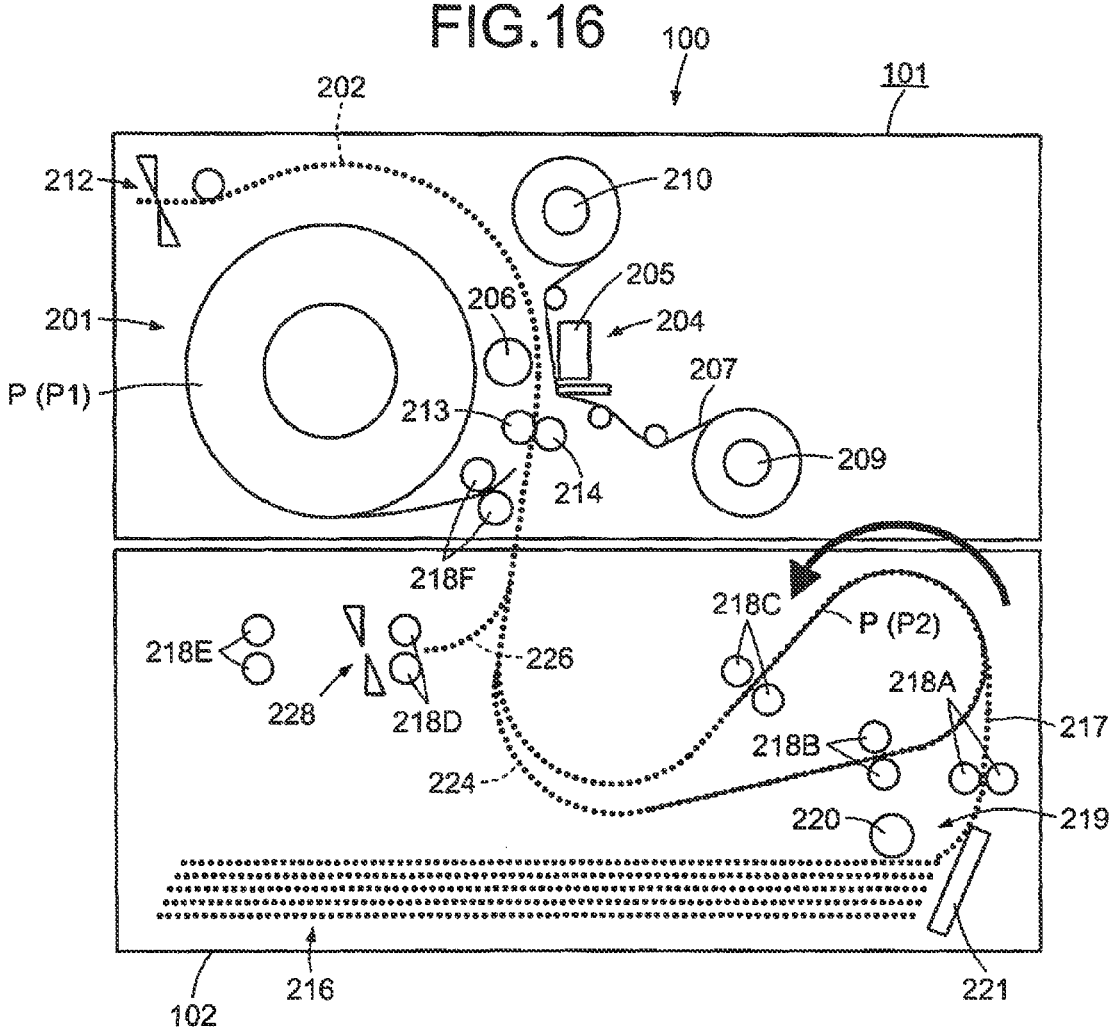
Figure 17:
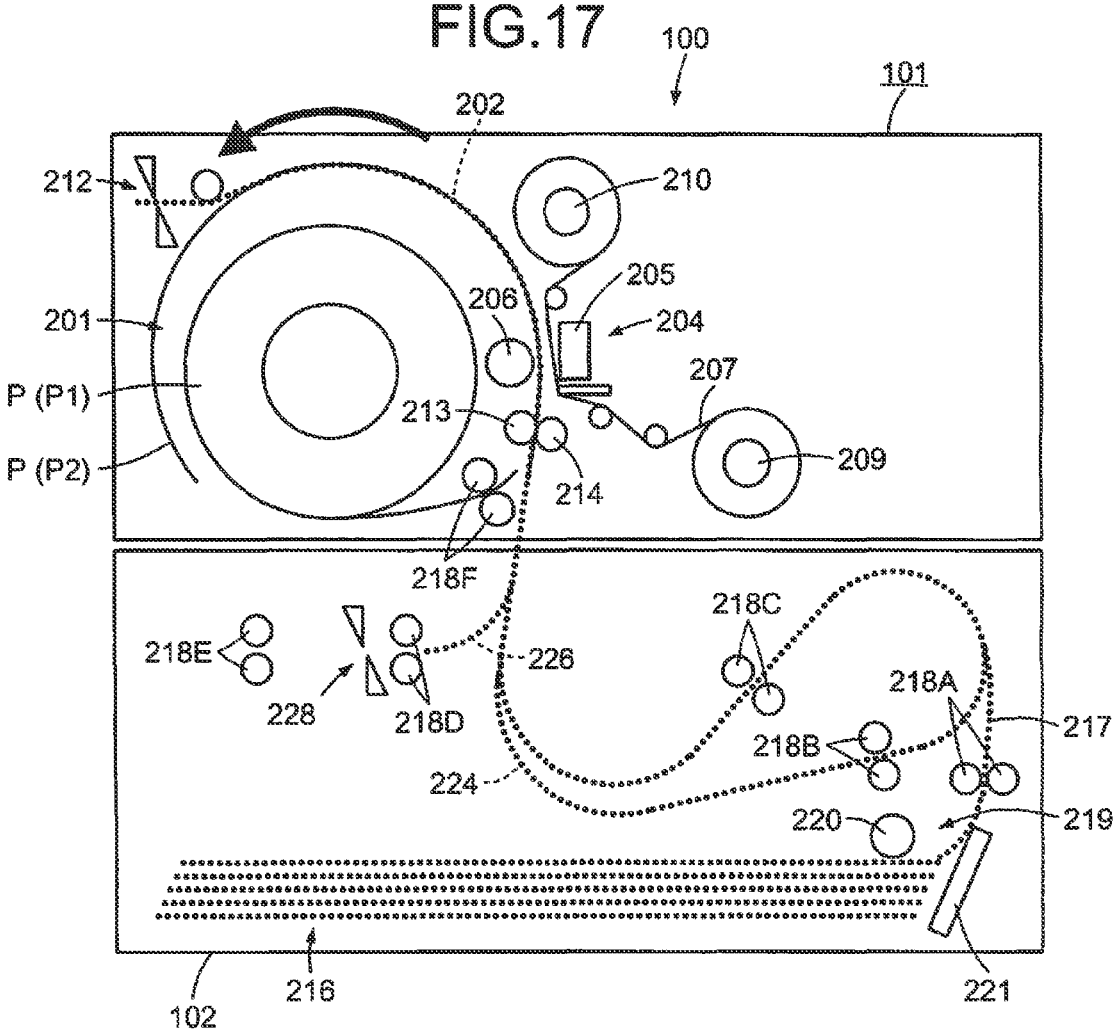

When the recording medium P (cut sheet P2) is fed back to the first recording medium transportation path 202 through the third recording medium transportation path 224, the side of the recording medium P (cut sheet P2) to be subject to recording is switched (see FIG. 16). The printer 100 keeps transporting the recording medium P (cut sheet P2) fed back to the first recording medium transportation path 202 until the front end of the recording medium P (cut sheet P2) reaches the print start position.

Figure 18:
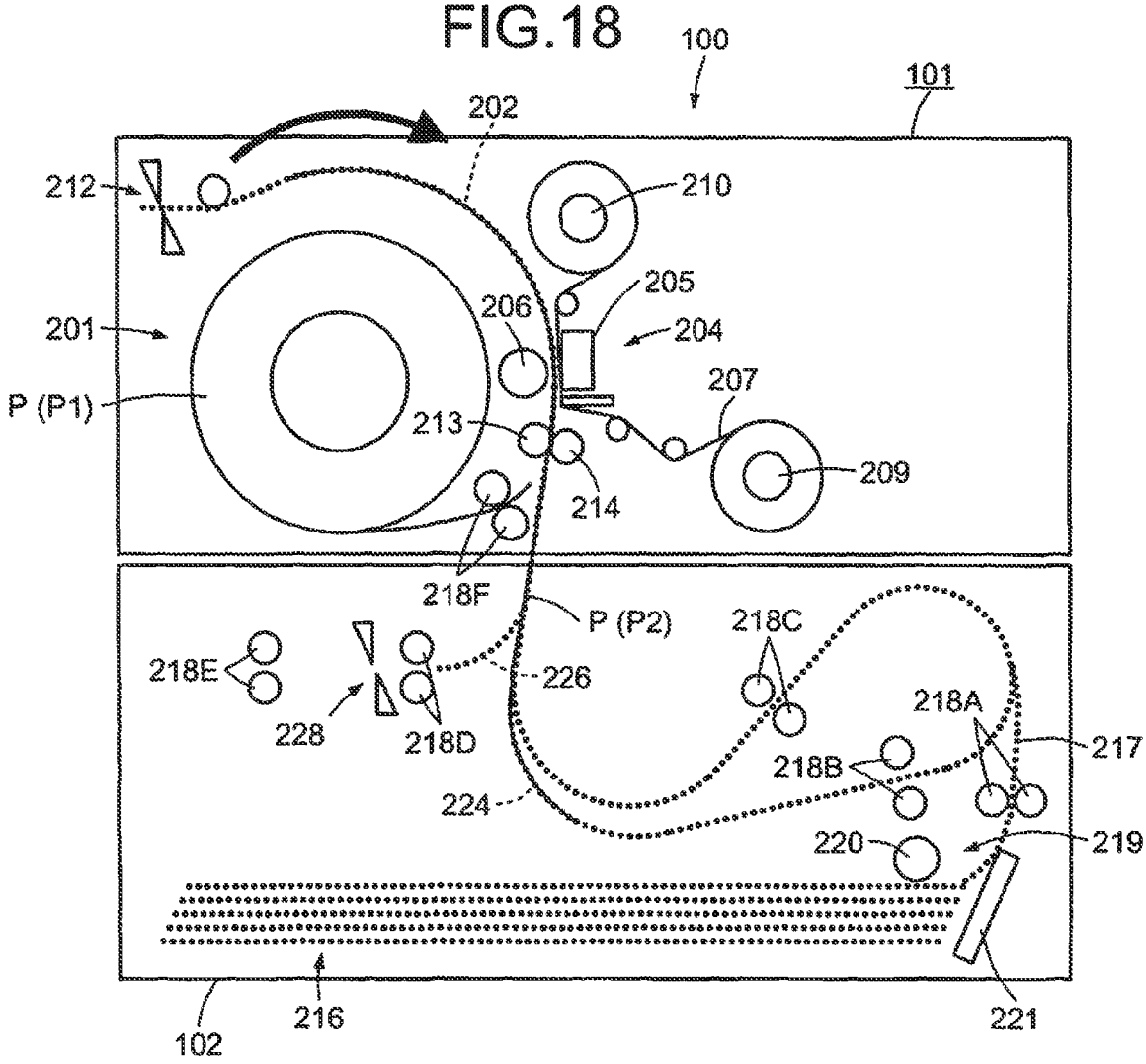

The printer 100 then causes the thermal head 205 to move closer to the platen 206 so that the thermal head 205 and the platen 206 hold the recording medium fed back to the first recording medium transportation path 202 and the ink ribbon 207 between the thermal head 205 and the platen 206, and causes the paper transporting rollers 218B to separate from each other so that the paper transporting rollers 218B retreat to a position at which the paper transporting rollers 218B do not touch the recording medium during a recording operation (see FIG. 18). In this state, as the recording medium fed back to the first recording medium transportation path 202 is transported in a direction in which the recording medium is drawn into the third recording medium, holding unit, the heat-generating elements of the thermal head 205 are selectively caused to generate heat based on the recording command information, through, which process a recording operation on the back, side of the recording medium is performed. Subsequently, an overcoat layer is formed on the back side in the same manner as the recording operation on the front face. After the completion of the recording operation on the back side of the recording medium, the thermal head 205 is separated from the platen 206.

Figure 19:
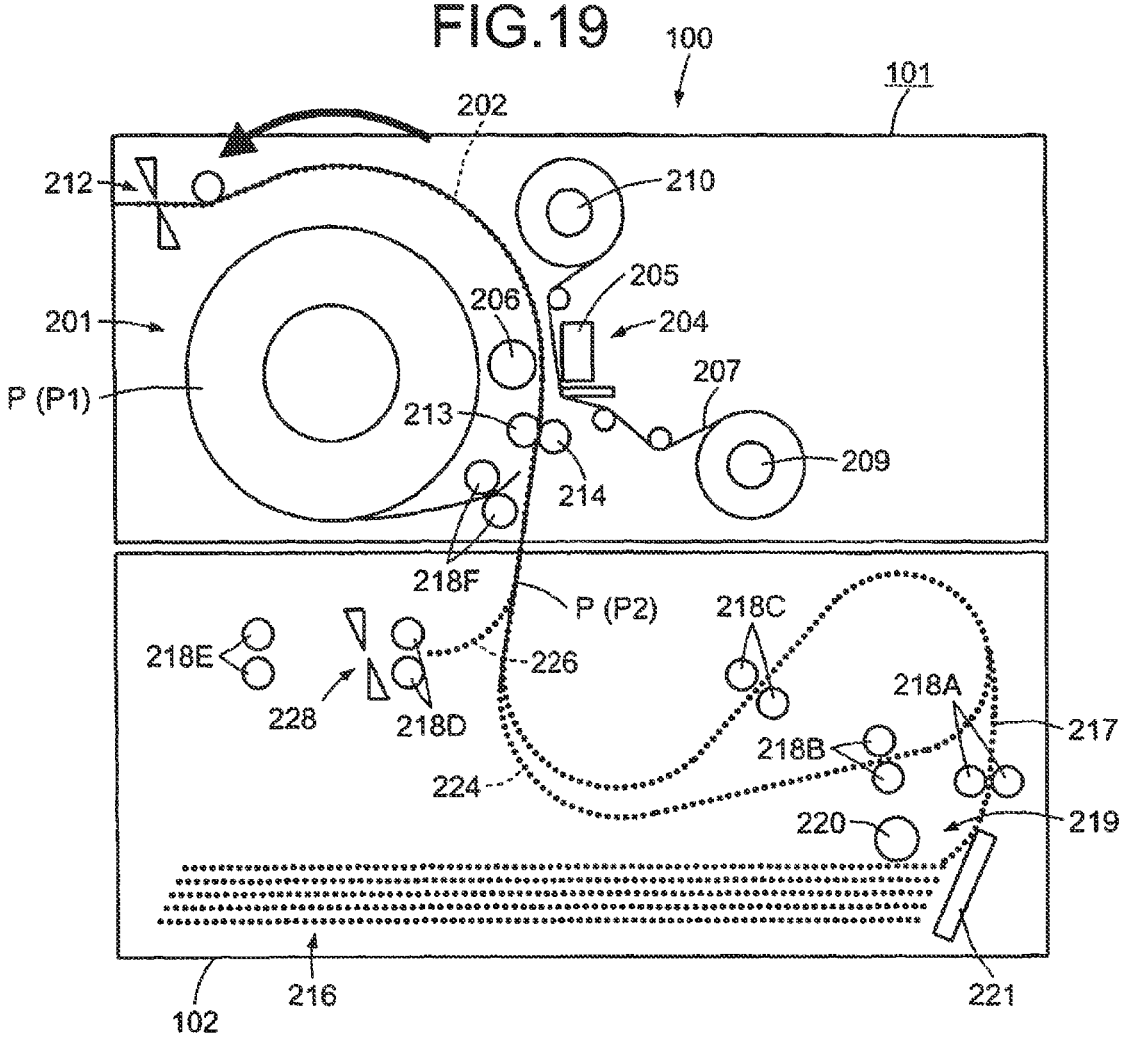

The printer 100 then drives and controls the motor driver 604 to be driven until the front end of the recording medium P (cut sheet P2) subjected to duplex recording is pulled out to pass the cut position, of the first cutter mechanism 212 and reach a given position (see FIG. 19). In this state, the motor driver 604 for the motor for the movable cutter of the first cutter mechanism 212 is driven and controlled to operate the movable cutter. As a result, a margin on one end of the recording medium subjected to duplex recording is cut away from a recorded object and stored in the first storage unit 215.

Figure 20:
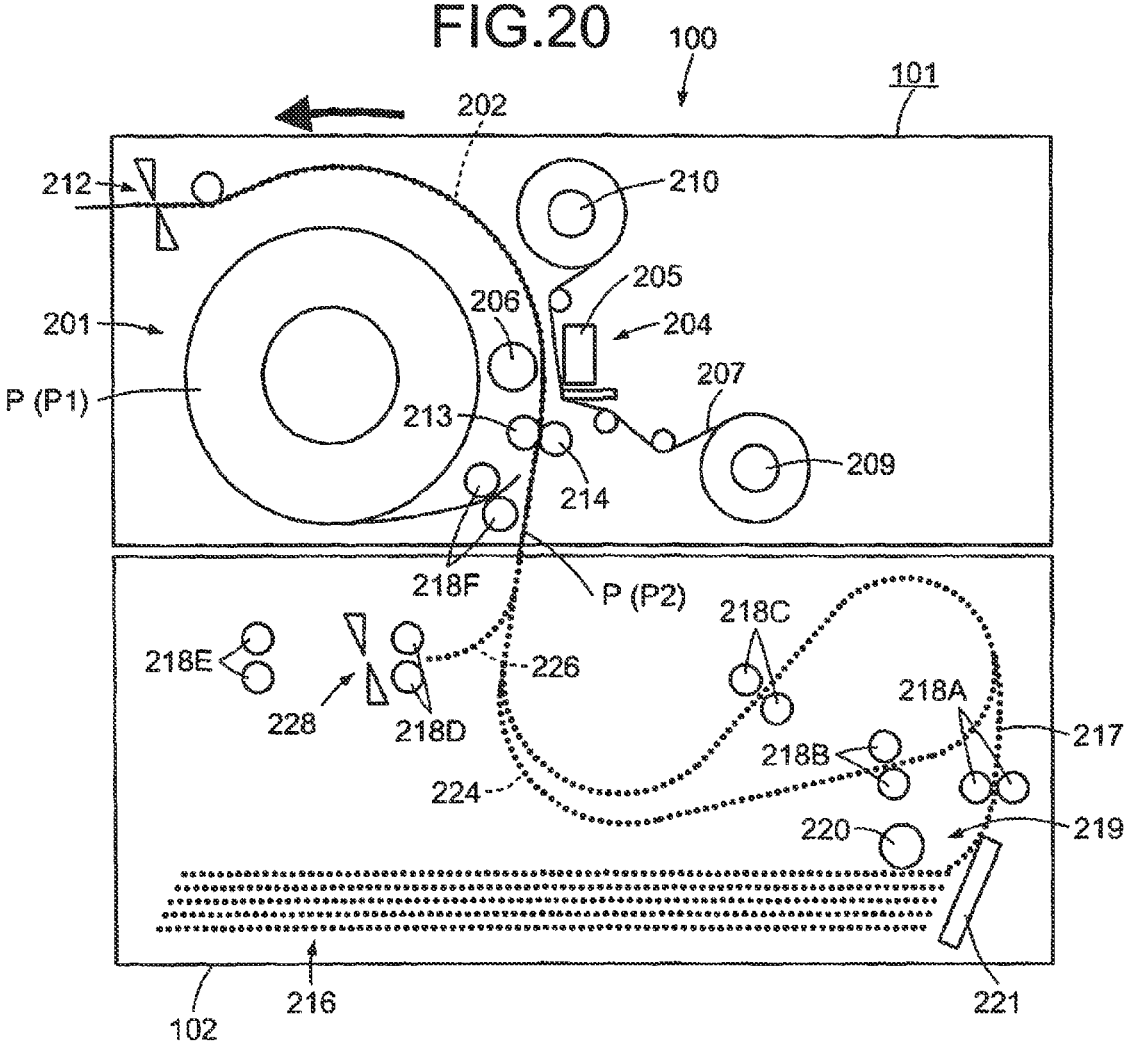
Figure 21:
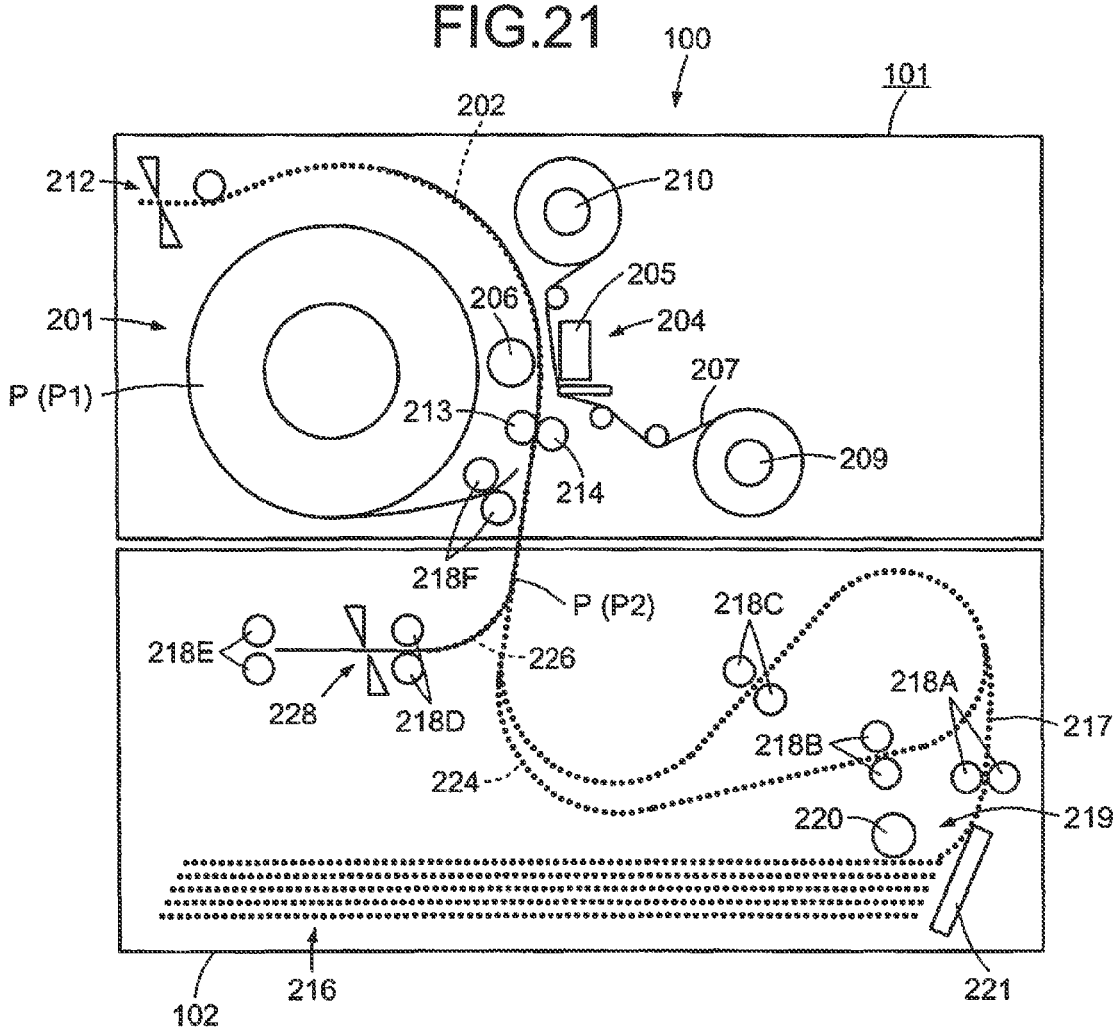
Figure 22:
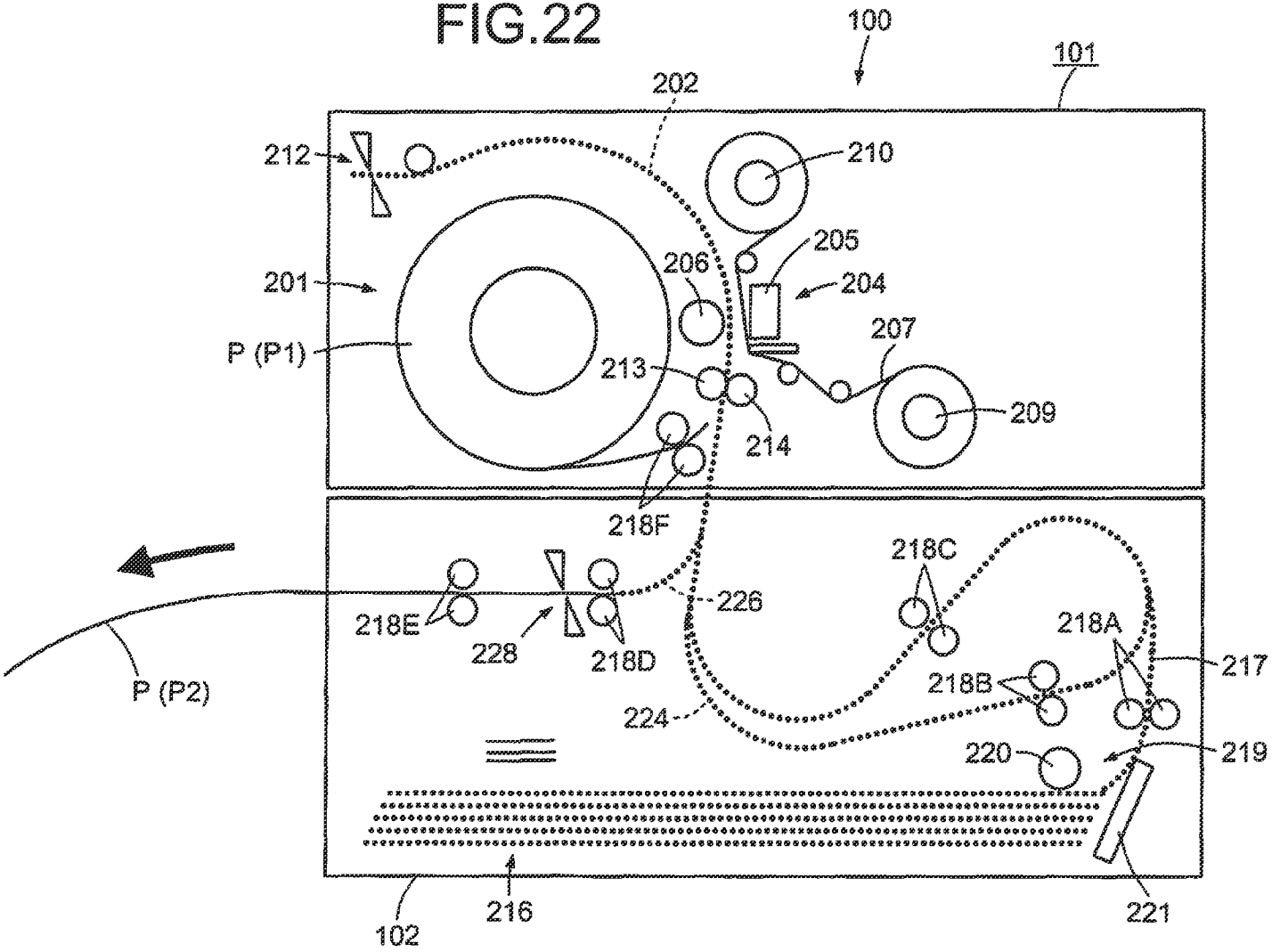

Subsequently, as necessary, the motor driver to be driven is driven and controlled to rotate the grip roller 213, which moves the recording medium to a position at which the recording medium does not hamper the positional shift of the flap 227 (see FIG. 20). The position of the flap is then shifted, and the motor driver to be driven is driven and controlled so that the paper transporting rollers 218D and 218E and the grip roller 213 are rotated in a direction in which the recording medium P (cut sheet P2) is transported toward the fourth recording medium transportation path 226. The motor driver 604 is driven and controlled until the other end of the recording medium P (cut sheet P2) having one end cut away passes the cutting position of the second cutter mechanism 228 and reaches a given position (see FIG. 21).

In this state, the motor driver 604 for the motor for the movable cutter of the second cutter mechanism 228 is driven and controlled, to operate the movable cutter. As a result, margins on both ends of the recording medium subjected to duplex recording are cut away from the recorded object and stored in the second storage unit 229. Subsequently, the motor driver 604 to be driven is driven and controlled to rotate the paper transporting rollers 218D and 218E and the grip roller 213, which ejects the recording medium P2 having both ends cut away, to the ejected-paper tray 106 through the duplex print ejection outlet 105 (see FIG. 22). In this manner, a cutting away of margins on both ends of the recording medium subjected to duplex recording provides a recorded object without margins (without a border).

Margin cutting is performed not only by the above process sequence. Margins on both ends of the cut sheet P2 may be cut away by the second cutter mechanism. In such a case, the position, of the flap is shifted in the same manner as described above, and the recording medium P2 finished with, duplex printing is transported to the fourth recording medium transportation path 226, where a margin on the front end is cut away. The recording medium P2 is then temporarily guided back toward the printer unit 101, during the course of which the side of the recording medium to be subject to recording is switched by the same procedure as described above, and the recording medium P2 is transported to the printer 101. The recording medium P2 is then, transported to the fourth recording medium transportation path 226, where the other margin is cut away.

The printer 100 of the embodiments has the following characteristics. The printer 100 of the embodiments is characterized in that the printer 100 includes the ordinary thermal transfer printer 100 (printer unit 101) that thermally transfers ink of the ink ribbon 207 to a single side of a rolled photographic paper, using the thermal head 205, to print an arbitrary image on the photographic paper and that cuts and ejects the photographic paper, and the paper-feeding/paper-reversing unit 102 that can feed the photographic paper cut by the printer 100 (printer unit 101) and that has at least one or more paper-feeding units and a paper-reversing unit capable of switching the side of a paper to be subject to recording, where the thermal transfer printer 100 and the paper-feeding/paper-reversing unit 102 being combined together to make up the printer 100.

As a result, the printer 100 of the embodiments can obtain a recorded object by selectively performing a recording operation on a recording medium suitable for simplex recording (photographic paper for simplex printing) held in the printer unit 101 and on a recording medium suitable for duplex recording (photographic paper for duplex printing) held in the paper-feeding/paper-reversing unit 102.

The printer 100 of the embodiments is characterized in that the side of the recording medium P (cut sheet P2) to be subject to recording is switched by a mechanism (reserving mechanism) that switches the side of the recording medium P (cut sheet P2) to be subject to recording relative to the recording position of the recording unit 204 by transporting the recording medium P (cut sheet P2) subjected to simplex recording through the looped third recording medium transportation path 224.

The printer 100 of the embodiments is characterized in that part of the second recording medium transportation path 217 for feeding the recording medium P (cut sheet P2) to the printer unit 101 and part of the third, recording medium transportation path 224 for switching the side of the recording medium P (cut sheet P2) to be subject to recording overlap each other.

The printer 100 of the embodiments is characterized in that the third recording medium transportation path 224 serving as a loop path for reversing a paper in the paper-feeding/paper-reversing unit 102 is provided with a mechanism that cleans the surface of the recording medium on which a recording operation is performed.

The printer 100 of the embodiments is characterized in that the paper-feeding/paper-reversing unit 102 includes the sheet feeding mechanism 219 that, picks sheet-like recording media P (cut sheets P2) held by the second recording medium holding unit 216 one by one to feed a picked recording medium P into the second recording medium transportation path 217, and the second cutter mechanism 228 that cuts away margins on both ends of the sheet-like recording medium P (cut sheet P2).

In performing duplex recording using the sheet-like recording medium P (cut sheet P2), to obtain a recorded medium without an excessive edge and that bears recorded matter covering the entire recording surface, margins on both ends of the recording medium, both ends being the front end and rear end in the direction of transportation, must be cut away. An ordinary printer designed to use the elongated recording medium P (rolled paper P1), which is cut into portions of a proper length for use, as an imprinting subject has a structure in which a cutting position is determined by holding the elongated recording medium P (rolled paper P1) before cutting it. Precisely cutting both ends of the sheet-like recording medium P (cut sheet P2) with a limited length is difficult.

The printer 100 of the embodiments is characterized in that the paper-feeding/paper-reversing unit 102 includes the second cutter mechanism 228 for cutting a margin away and the duplex print ejection outlet 105. The printer 100 is thus characterized, in that during a recording operation using the sheet-like recording medium P (cut sheet P2), when a margin is cut away from the sheet-like recording medium P (cut sheet P2), the sheet-like recording medium P (cut sheet P2) is fixed to cut away the margin precisely.

The printer 100 of the embodiments is characterized in that the storage box for storing cut margin pieces is disposed under the cutter included in the paper-feeding/paper-reversing unit 102. The printer 100 of the embodiments is characterized in that a recorded object subjected to simplex recording and a recorded object subjected to duplex recording are ejected out of different ejection outlets (simplex print ejection outlet 104 and duplex print ejection outlet 105), respectively.

The printer 100 of the embodiments is characterized in that the distance between the cutting position of the second cutter mechanism 228 disposed in the paper-feeding/paper-reversing unit 102 and the grip roller 213 in the printer 100 is determined to be shorter than the length of the corresponding shortest printed, matter made by duplex recording on the recording medium P2. As a result, the margins of the recording medium can be cut away precisely when duplex recording is performed.

The printer 100 of the embodiments is characterized in that the connecting part between the printer unit 101 and the paper-feeding/paper-reversing unit 102 has a shape for positioning. The printer 100 of the embodiments is characterized in that the paper transporting rollers 218B of the paper-feeding/paper-reversing unit 102 retreat to a position at which the transporting rollers 218B do not touch the recording medium during a recording operation, and move to a position at which the transporting rollers 218B can transport the recording medium when reversing the recording medium. A roller that touches the paper during a printing process brings an irregular printing result. The printer 100 causes the paper transporting rollers 218B of the paper-feeding/paper-reversing unit 102 to retreat, thereby prevents the occurrence of irregular printing to offer quality printed matter.

The printer 100 of the embodiments is characterized in that the paper-feeding/paper-reversing unit 102 has a position adjusting unit for adjusting the position, of the paper in its width direction. The paper, therefore, is adjusted to left/right printing positions and is given a corrected, paper-feeding angle before being fed to the printer 100. This suppresses the irregularity of the left/right printing positions to offer quality recorded, object.

The printer 100 of the embodiments is characterized in that one motor is in charge of the operation of feeding the sheet-like recording medium P (cut sheet. P2) held, by the second recording medium holding unit 216 to the second recording medium transportation path 217 (picking/sending off operation) and the operation of transporting the recording medium P (cut sheet P2) fed (picked and sent off) to the second recording medium transportation path 217, from the paper-feeding/paper-reversing unit 102 to the printer unit 101, that is, one motor is in charge of the operation of picking and sending off the recording medium P (cut sheet P2) and the operation of feeding the picked paper from the paper-feeding/paper-reversing unit 102 to the printer unit 101, and that each of the operations can be executed selectively by switching the direction of rotation of the motor.

The printer 100 of the embodiments is characterized in that the motor that gives a driving force to the paper transporting rollers 218B is in charge of the operation by the paper transporting rollers 218B that do not touch the recording medium during a recording operation and when transporting the recording medium, moves to a position at which the paper transporting rollers 218B can transport the recording medium.

The printer 100 of the embodiments is characterized in that the printer 100 includes a flap mechanism that changes the transportation route over to the third recording medium transportation path 224 or to the fourth recording medium transportation path 226, and that the motor that drives the paper transporting rollers 218D and 218E disposed on the ejection side also drives the flap mechanism.

The printer 100 of the embodiments is characterized in that the paper-feeding/paper-reversing unit 102 operates with power supplied from the power supply included in the printer unit 101. During the recording operation, which requires the most power, the paper-feeding/paper-reversing unit 102 moves the least. The printer 100 of the embodiments is characterized in that taking into consideration that during the recording operation there is less movement of the paper-feeding/paper-reversing unit 102, power is diverted, from the power supply included in the printer unit 101 to the paper-feeding/paper-reversing unit 102 to cover power consumed, by the paper-feeding/paper-reversing unit 102 without adding another power supply to the printer unit 101. In this manner, the use of the common power supply by the printer 100 and paper-feeding/paper-reversing unit 102 simplifies the configuration of the printer 100, thereby reduces the size of the printer 100 and manufacturing costs.

The printer 100 of the embodiments is characterized in that the computer 601 (control board) of the printer unit 101 controls the paper-feeding/paper-reversing unit 102. Control over the paper-feeding/paper-reversing unit 102 is easier than control over the printer unit 101. By controlling the paper-feeding/paper-reversing unit 102 by the microcomputer 601 of the printer unit 101, the operation of the paper-feeding/paper-reversing unit 102 can be controlled without providing a dedicated control board for driving the paper-feeding/paper-reversing unit 102.

In this manner, the use of the common microcomputer 601 that controls both printer unit 101 and paper-feeding/paper-reversing unit 102 simplifies the configuration of the printer 100, thereby reduces the size of the printer 100 and manufacturing costs.

The printer 100 of the embodiments is characterized in that some of guide members making up paper transportation paths have a structure such that the guide members can open and close and facilitate restoration work when paper jamming, etc., occurs, and that the guide members are disposed in a location that can be accessed from the front face of the printer 100.

The printer 100 of the embodiments is characterized in that the paper picking/sending off roller 220 is made of silicon rubber. When the recording medium for duplex recording is assumed, the roller comes in contact with the photographic face of the image-receiving paper before a recording operation is performed thereon. For example, when, the roller is made of an ethylene-propylene rubber (EPDM), etc., a plasticizer in the roller affects the image-receiving paper (softens a receiving layer) to cause density irregularity in some cases. The printer 100 of the embodiments can suppress density irregularity that occurs when the paper picking/sending off roller 220 comes in contact with the image-receiving paper.

The printer 100 of the embodiments is characterized in that a roller affecting print quality among the paper transporting rollers 218 is made of silicon rubber. The printer 100 of the embodiments is characterized in that a frictional material that is used in a separating mechanism of the paper picking/sending off unit and that comes in contact with the image-receiving paper surface is made of a silicon rubber. This suppresses the occurrence of density irregularity of the image-receiving paper that comes in contact with the paper transporting rollers 218 and with the paper separating unit (frictional sheet) 221.

The printer 100 of the embodiments is characterized in that respective surfaces of the paper picking/sending off roller 220, a required roller among the paper transporting rollers 218, and the paper separating unit (friction sheet) 221 are not smooth. If the paper picking/sending off roller 220, the required roller among the paper transporting rollers 218, and the paper separating unit (friction sheet) 221 have smooth surfaces, a stable frictional force is not exerted. For example, when the surfaces of frictional materials are smooth, smooth surfaces in contact with each other create an extremely large frictional force, in which case, however, that frictional force decreases sharply when paper powder, etc., is present on the surfaces. The paper picking/sending off roller 220, the required roller among the paper transporting rollers 218, and the paper separating unit (friction sheet) 221 are made of frictional materials having irregular surfaces. This reduces the effect of paper powder, thereby offers a stable frictional force.

The printer 100 of the embodiments, therefore, offers a stable frictional force and performs stable transportation.

The printer 100 of the embodiments may have a structure such that in the paper-feeding/paper-reversing unit 102, the rolled recording medium P (rolled paper P1) is held in place of the sheet-like recording medium P (cut sheet P2) and is cut into portions of a given length that are supplied as recording media.

According to the printer 100 of the embodiments, the third recording medium transportation path 224 in which the front face and back side of the recording medium is reversed may be provided with a thermal transfer unit that transfers, for example, thermofusible ink, transfer foil, etc. In this case, the recording medium may be transported by the platen of the thermal transfer unit. In YMC surface sequence printing in which a state of out-of-color-registration occurs frequently, transportation by the grip roller 213 is imperative. In an application that requires less precision in positioning, however, the recording medium is transported by the platen of the thermal transfer unit. This prevents additional deterioration of a printed matter caused by the projections of the transporting rollers.

As described above, in the printer 100 of the embodiments including the printer unit 101 and the reversing unit, the printer unit 101 performs a recording operation on the recording medium P (rolled paper P1) pulled out from the first recording medium holding unit 201 and on the recording medium P (cut sheet P2) held by the second recording medium holding unit 216 included in the paper-feeding/paper-reversing unit 102.

According to the printer 100 of the embodiments, the same recording operation is performed regardless of which of simplex recording and duplex recording is to be executed. This prevents a case where process load on each of the units of the printer 100 at execution of duplex recording becomes greater than that at execution of simplex recording.

The printer 100 of the embodiments is characterized in that the printer 100 includes the printer unit 101 that holds the recording medium P (rolled paper P1) suitable for simplex recording and that, performs a recording operation (simplex recording) on the recording medium P (rolled paper P1), and the paper-feeding/paper-reversing unit 102 having the second recording medium transportation path 217 for feeding the recording medium P (cut sheet P2) suitable for duplex recording to the recording unit and the third recording medium transportation path 224 for switching the side of the recording medium P (cut sheet P2) subjected to simplex recording.

According to the printer 100 of the embodiments, a recording medium suitable for simplex recording can be used for simplex recording, while a recording medium suitable for duplex recording can be used for duplex recording. Hence, high quality recording is ensured constantly, regardless of the recording surfaces of the recording medium.

As a result, according to the printer 100 of the embodiments, high quality recording is ensured by using each recording medium suitable for each use, and an increase in the size of the printer caused by holding each recording medium suitable for each use can be prevented.

The printer 100 of the embodiments is characterized in that the paper-feeding/paper-reversing unit 102 includes the third recording medium transportation path 224 through which the side of the recording medium P (cut sheet P2) subjected to simplex recording is switched and the recording medium P is thus fed back to the recording unit 204 of the printer unit 101, and that the third recording medium transportation path 224 partially overlaps the second recording medium transportation path 217 through which the recording medium P (cut sheet P2) is fed to the printer unit 101.

According to the printer 100 of the embodiments, the size of the printer 100 that performs duplex recording can be reduced, compared to a case where the recording medium transportation paths (second recording medium transportation path 217 and third recording medium transportation path 224) are independent of each other.

The printer 100 of the embodiments is characterized in that the printer 100 includes the printer unit 101 that holds the recording medium P (rolled paper P1) suitable for simplex recording and that performs a recording operation on the recording medium P (rolled paper P1), and the paper-feeding/paper-reversing unit 102 in which the second recording medium transportation path 217 for feeding the recording medium P (cut sheet P2) suitable for duplex recording to the recording unit and the third recording medium transportation path 224 for reversing the front face and back side of the recording medium P (cut sheet P2) subjected to simplex recording partially overlap each other.

As a result, according to the printer 100 of the embodiments, an increase in the size of the printer caused by holding each recording medium suitable for each use is prevented, and high recording quality is ensured constantly, regardless of the recording surfaces of the recording medium, by using the recording medium suitable for simplex recording when simplex recording is performed and using the recording medium suitable for duplex recording when duplex recording is performed.

In this manner, according to the printer 100 of the embodiments, high quality recording is ensured by using each recording medium suitable for each use, and an increase in the size of the printer caused by holding each recording medium suitable for each use can be prevented. Performing the recording operation regardless of which of simplex recording and duplex recording is to be executed prevents a case where process load on each of the units of the printer 100 at execution of duplex recording becomes greater than the same at execution of simplex recording.

The printer 100 of the embodiments is characterized in that the printer unit 101 includes the microcomputer unit 601 that drives and controls each of the units of the printer unit 101 and each of the units of the paper-feeding/paper-reversing unit 102, and that the printer unit 101 can be separated from the paper-feeding/paper-reversing unit 102.

According to the printer 100 of the embodiments, because the printer unit 101 and the paper-feeding/paper-reversing unit 102 are different units separable from each other, a unit to be installed in the printer 100 can be selected according to the intended use of the printer 100. For example, when the printer 100 is used for only the simplex recording, only the printer unit 101 is installed. When the printer 100 is used for only the duplex recording, only the paper-feeding/paper-reversing unit 102 is installed.

As a result, according to the printer 100 of the embodiments, the manufacturing cost of the printer 100 can be reduced and customer demands can be met flexibly, compared to a case where multiple types of printers 100 are manufactured according to the uses of the printers 100.

The printer 100 of the embodiments is characterized in that the paper-feeding/paper-reversing unit 102 includes a cleaning unit that cleans the surface of the recording medium on which a recording operation is performed, the recording medium being transported through the third recording medium transportation path 224, in which the front face and back side of the recording medium is reversed relative to the recording position of the recording unit 204, and being fed to the first recording medium transportation path 202.

According to the printer 100 of the embodiments, during transportation of the recording medium subjected to simplex recording, even if foreign matter, such as paper powder produced on an end aspect, etc., of the recording medium P (cut sheet P2) subjected to simplex recording, sticks to the non-recording surface (back side) of the recording medium P (cut sheet P2) subjected to simplex recording, the foreign matter is removed and then a recording operation is performed on the back side. According to the printer 100 of the embodiments, therefore, high recording quality is ensured on both sides of the recording medium P (cut sheet P2).

The printer 100 of the embodiments is characterized in that the printer unit 101 includes the grip roller 213 and the pinch, roller 214 that control the position of the recording medium (rolled paper P1, cut sheet P2) transported through the first recording medium transportation path 202, relative to the recording position of the recording unit 204 during a recording operation and to the cutting position of the first cutter mechanism 212 during its cutting operation.

According to the printer 100 of the embodiments, regardless of which of simplex recording and duplex recording is performed, the position of the recording medium (rolled paper P1, cut sheet P2) transported through the first recording medium transportation path 202 can be controlled using the grip roller 213 and the pinch roller 214. As a result, according to the printer 100 of the embodiments, the size of the printer 100 that performs duplex recording can be reduced, compared to a case where the grip roller 213 and the pinch roller 214 are provided for each of simplex recording operation and duplex recording operation.

The printer 100 of the embodiments is characterized in that the grip roller 213 and the pinch roller 214 control the position of the recording medium transported through the fourth recording medium transportation path 226 extending from the first recording medium transportation path 202 to the duplex print ejection outlet 105.

According to the printer 100 of the embodiments, the first cutter mechanism 212 and the first cutter mechanism 228 can be used selectively when an unnecessary margin, etc., is cut away from the recording medium (cut sheet, etc.). As a result, according to the printer 100 of the embodiments, the recording medium as the imprinting subject can be transported through the optimum path according to the type of the recording medium. This improves a degree of freedom of choosing a path for transporting the recording medium.

The printer 100 of the embodiments is characterized in that the recording unit 204 performs a recording operation by the sublimation/transfer method on the recording medium. According to the printer 100 of the embodiments, the high recording quality of a recorded object is secured, the recorded object being obtained by the recording operation by the sublimation/transfer method suitable for DTP applications, etc., of printing out a picture taken by a digital camera, and the size of the printer 100 can be reduced, compared to a printer 100 of a conventional type that performs a recording operation by the sublimation/transfer method on both sides of the recording medium.

As a result, according to the printer 100 of the embodiments, the amount of a space required for installing the printer 100 can be kept smaller, compared to a conventional duplex printer using the sublimation/transfer method. According to the printer 100 of the embodiments, for example, a service of providing a duplex recorded object made by recording a picture taken by a digital camera by the sublimation/transfer method is available at a small-sized store offering DPE service.

As described above, the printer is usable as a printer that can perform recording on both sides of a recording medium, and is particularly applicable as a printer that can perform recording on both sides of a recording medium by executing a recording operation by the sublimation/transfer method.

The printer according to the present embodiments ensures high recording quality by using a suitable recording medium according to use and suppresses an increase in the size of the printer resulting from storage of the recording media for each use.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A printer comprising a recording unit and a reversing unit, wherein the recording unit includes:

a first recording medium holding unit that holds a rolled recording medium such that the recording medium can be pulled out from an outer peripheral aspect;

a recording unit that pulls out the recording medium held by the first recording medium holding unit, transports the pulled out recording medium through a first recording medium transportation path extending from the first recording medium holding unit to a first recording medium ejection position, and performs a recording operation on the recording medium on transportation; and a first recording medium cutting unit that cuts the recording medium transported through the first recording medium transportation path by the recording unit, at a given position before the recording medium reaches the first recording medium ejection position, and the reversing unit includes:

a second recording medium holding unit that holds a sheet-like recording medium;

a sheet feeding unit that pulls out the sheet-like recording medium held by the second recording medium holding unit to a second recording medium transportation path extending from the second recording medium holding unit to the first recording medium transportation path, the sheet feeding unit feeding the pulled out sheet-like recording medium to the first recording medium transportation path; and a recording medium reversing unit that with respect to the sheet-like recording medium ejected from the recording unit to a third recording medium transportation path of which both ends are continuous with the first recording medium transportation path, switches relative to a recording position of the recording unit, the side of the sheet-like recording medium to be subject to recording, and feeds the sheet-like recording medium to the first recording medium transportation path, wherein the recording unit performs a recording operation on the sheet-like recording medium that has been fed to the first recording medium transportation path by the sheet feeding unit and on the sheet-like recording medium that has been subject to switching by the recording medium reversing unit and fed to the first recording medium transportation path.

2. The printer according to claim 1, wherein the third recording medium transportation path partially overlaps the second recording medium transportation path.

3. The printer according to claim 1, wherein the recording unit includes a control unit that drives and controls each unit included in the recording unit and each unit included in the reversing unit, and can be detached from the reversing unit.

4. The printer according to claim 1, wherein the reversing unit includes a cleaning unit that cleans a surface of the sheet-like recording medium on which the recording operation is performed by the recording unit, the sheet-like recording medium having been subject to switching by the recording medium reversing unit and fed to the first recording medium transportation path.

5. The printer according to claim 1, wherein the recording unit includes a position control unit that controls the position of the recording medium transferred through the first recording medium transportation path, relative to the recording position of the recording unit during the recording operation and to a cutting position of the first recording medium cutting unit during a cutting operation.

6. The printer according to claim 5, wherein the reversing unit includes:

a recording medium ejecting unit having a fourth recording medium transportation path extending from the first recording medium transportation path to a second recording medium ejection position different from the first recording medium ejection position, the recording medium ejecting unit transporting the sheet-like recording medium ejected from the first recording medium transportation path to the fourth recording medium transportation path, to the second recording medium ejection position; and a second recording medium cutting unit that cuts the sheet-like recording medium transferred through the fourth recording medium transportation path by the recording medium ejecting unit, before the sheet-like recording medium reaches the second recording medium ejection position, and the position control unit further controls the position of the sheet-like recording medium transferred through the fourth recording medium transportation path by the recording medium ejecting unit, relative to the cutting position of the second recording medium cutting unit during the cutting operation.

7. The printer according to claim 1, wherein the recording unit performs the recording operation by a sublimation/transfer method.

* * * * *